US009751692B2

(12) United States Patent
Yang et al.

(10) Patent No.: US 9,751,692 B2
(45) Date of Patent: Sep. 5, 2017

(54) DUAL SENSING RECEPTACLES

(71) Applicant: simplehuman, LLC, Torrance, CA (US)

(72) Inventors: Frank Yang, Rancho Palos Verdes, CA (US); David Wolbert, Manhattan Beach, CA (US); Kenneth Yen, Redondo Beach, CA (US); Guy Cohen, Marina Del Rey, CA (US); Frederick N. Bushroe, Tucson, AZ (US); Perry Anderson, Kensington, CA (US); Michael James Basha, San Francisco, CA (US); Christopher B. Fruhauf, San Anselmo, CA (US); Azhar Meyer, San Francisco, CA (US); Bradley William Steiner, San Francisco, CA (US); Brian Y. Tachibana, San Carlos, CA (US); Jesse Dethman, San Francisco, CA (US)

(73) Assignee: simplehuman, LLC, Torrance, CA (US)

( * ) Notice: Subject to any disclaimer, the term of this patent is extended or adjusted under 35 U.S.C. 154(b) by 0 days.

(21) Appl. No.: 14/639,862

(22) Filed: Mar. 5, 2015

(65) Prior Publication Data

US 2015/0259140 A1 Sep. 17, 2015

Related U.S. Application Data

(60) Provisional application No. 61/953,402, filed on Mar. 14, 2014.

(51) Int. Cl.
*F04D 15/00* (2006.01)
*B65F 1/16* (2006.01)
(Continued)

(52) U.S. Cl.
CPC ..... *B65F 1/1638* (2013.01); *B65F 1/1646* (2013.01); *E05F 15/73* (2015.01);
(Continued)

(58) Field of Classification Search
CPC ..... G02B 6/4452; H02P 9/06; Y02T 10/7005; B60W 10/08
(Continued)

(56) References Cited

U.S. PATENT DOCUMENTS 830,182 A 9/1906 Skov
1,426,211 A 8/1922 Pausin
(Continued)

FOREIGN PATENT DOCUMENTS

AU 622536 4/1992
CA 2519295 3/2007
(Continued)

OTHER PUBLICATIONS

International Search Report and Written Opinion in corresponding International Application No. PCT/US2015/19997, mailed Jul. 28, 2015, 12 pages.
(Continued)

*Primary Examiner* — Rina Duda
(74) *Attorney, Agent, or Firm* — Knobbe, Martens, Olson & Bear, LLP

(57) ABSTRACT

A trashcan assembly can include a body portion, a lid portion pivotably coupled with the body portion, and a sensor assembly configured to generate a signal when an object is detected within a sensing region. The sensor assembly can include a plurality of transmitters having a first subset of transmitters and a second subset of transmitters. A transmission axis of least one transmitter in the first subset of transmitters can be different from a transmission axis of at least one of the transmitters in the second subset of
(Continued)

transmitters. An electronic processor can generate an electronic signal to a power-operated drive mechanism for moving the lid portion from a closed position to an open position when the sensor assembly detects the object within the sensing region.

22 Claims, 21 Drawing Sheets

(51) Int. Cl.
*E05F 15/73* (2015.01)
*B65F 1/04* (2006.01)
*B65F 1/06* (2006.01)

(52) U.S. Cl.
CPC . *B65F 1/04* (2013.01); *B65F 1/06* (2013.01); *B65F 1/062* (2013.01); *B65F 1/1607* (2013.01); *B65F 2210/181* (2013.01); *B65F 2210/1815* (2013.01); *B65F 2250/11* (2013.01); *B65F 2250/111* (2013.01); *B65F 2250/112* (2013.01); *B65F 2250/114* (2013.01); *Y10T 29/49002* (2015.01)

(58) Field of Classification Search
USPC ..... 318/3, 9, 14, 139, 560
See application file for complete search history.

(56) References Cited

U.S. PATENT DOCUMENTS 1,461,253 A 7/1923 Owen
1,754,802 A 4/1930 Raster
1,820,555 A 8/1931 Buschman
1,891,651 A 12/1932 Padelford et al.
1,922,729 A 8/1933 Geibel
1,980,938 A 11/1934 Geibel
2,308,326 A 1/1943 Calcagno
D148,825 S 2/1948 Snider
2,457,274 A 12/1948 Rifken
2,759,625 A 8/1956 Ritter
2,796,309 A 6/1957 Norris
2,888,307 A 5/1959 Graves et al.
2,946,474 A 7/1960 Knapp
3,008,604 A 11/1961 Garner
3,023,922 A 3/1962 Arrington et al.
3,137,408 A 6/1964 Taylor
3,300,082 A 1/1967 Patterson
3,392,825 A 7/1968 Gale et al.
3,451,453 A 6/1969 Heck
3,654,534 A 4/1972 Fischer
3,800,503 A 4/1974 Maki
3,820,200 A 6/1974 Myers
3,825,150 A 7/1974 Taylor
3,825,215 A 7/1974 Borglum
3,886,425 A 5/1975 Weiss
3,888,406 A 6/1975 Nippes
3,891,115 A 6/1975 Ono
4,014,457 A 3/1977 Hodge
4,027,774 A 6/1977 Cote
4,081,105 A 3/1978 Dagonnet et al.
4,189,808 A 2/1980 Brown
4,200,197 A 4/1980 Meyer et al.
4,217,616 A 8/1980 Jessup
4,303,174 A 12/1981 Anderson
4,320,851 A 3/1982 Montoya
4,349,123 A 9/1982 Yang
4,357,740 A 11/1982 Brown
4,416,197 A 11/1983 Kehl
4,417,669 A 11/1983 Knowles et al.
4,457,483 A 7/1984 Gagne
4,535,911 A 8/1985 Goulter
4,570,304 A 2/1986 Montreuil et al.
4,576,310 A 3/1986 Isgar et al.
D284,320 S 6/1986 Kubic et al.
4,609,117 A 9/1986 Pamment
4,630,332 A 12/1986 Bisbing
4,630,752 A 12/1986 DeMars
4,664,347 A 5/1987 Brown et al.
4,697,312 A 10/1987 Freyer
4,711,161 A 12/1987 Swin et al.
4,729,490 A 3/1988 Ziegenbein
4,753,367 A 6/1988 Miller et al.
4,763,808 A 8/1988 Guhl et al.
4,765,548 A 8/1988 Sing
4,765,579 A 8/1988 Robbins, III et al.
4,785,964 A 11/1988 Miller et al.
4,792,039 A 12/1988 Dayton
4,794,973 A 1/1989 Perisic
4,813,592 A 3/1989 Stolzman
4,823,979 A 4/1989 Clark, Jr.
4,834,260 A 5/1989 Auten
4,863,053 A 9/1989 Oberg
4,867,339 A 9/1989 Hahn
4,869,391 A 9/1989 Farrington
4,884,717 A 12/1989 Bussard et al.
4,888,532 A * 12/1989 Josson ..... G01S 17/026 250/208.6
4,892,223 A 1/1990 DeMent
4,892,224 A 1/1990 Graham
4,913,308 A 4/1990 Culbertson
4,915,347 A 4/1990 Iqbal et al.
4,918,568 A 4/1990 Stone et al.
D308,272 S 5/1990 Koepsell
4,923,087 A 5/1990 Burrows
4,944,419 A 7/1990 Chandler
4,948,004 A 8/1990 Chich
4,964,523 A 10/1990 Bieltvedt et al.
4,972,966 A 11/1990 Craft, Jr.
4,996,467 A 2/1991 Day
5,031,793 A 7/1991 Chen et al.
5,048,903 A 9/1991 Loblein
5,054,724 A 10/1991 Hutcheson
5,065,272 A 11/1991 Owen et al.
5,065,891 A 11/1991 Casey
5,076,462 A 12/1991 Perrone
D323,573 S 1/1992 Schneider
5,090,585 A 2/1992 Power
5,090,785 A 2/1992 Stamp
5,100,087 A 3/1992 Ashby
5,111,958 A 5/1992 Witthoeft
D327,760 S 7/1992 Donnelly
D329,929 S 9/1992 Knoedler et al.
5,147,055 A 9/1992 Samson et al.
5,156,290 A 10/1992 Rodrigues
D331,097 S 11/1992 Sieren
5,170,904 A 12/1992 Neuhaus
5,174,462 A 12/1992 Hames
D335,562 S 5/1993 Evans
5,213,272 A 5/1993 Gallagher et al.
5,222,704 A 6/1993 Light
D337,181 S 7/1993 Warman
5,226,558 A 7/1993 Whitney et al.
5,230,525 A 7/1993 Delmerico et al.
5,242,074 A 9/1993 Conaway et al.
D340,333 S 10/1993 Duran et al.
5,249,693 A 10/1993 Gillispie et al.
5,261,553 A 11/1993 Mueller et al.
5,265,511 A 11/1993 Itzov
5,295,607 A 3/1994 Chang
5,305,916 A 4/1994 Suzuki et al.
5,314,151 A 5/1994 Carter-Mann
5,322,179 A 6/1994 Ting
5,329,212 A * 7/1994 Feigleson ..... B65F 1/1638 220/260
5,348,222 A 9/1994 Patey
5,353,950 A 10/1994 Taylor et al.
5,372,272 A 12/1994 Jennings
5,381,588 A 1/1995 Nelson
5,385,258 A 1/1995 Sutherlin
5,390,818 A 2/1995 LaBuda
5,404,621 A 4/1995 Heinke
5,407,089 A 4/1995 Bird et al.

(56) References Cited

U.S. PATENT DOCUMENTS 5,419,452 A 5/1995 Mueller et al.
5,471,708 A 12/1995 Lynch
5,474,201 A 12/1995 Liu
5,501,358 A 3/1996 Hobday
5,520,067 A 5/1996 Gaba
5,520,303 A 5/1996 Bernstein et al.
5,531,348 A 7/1996 Baker et al.
5,535,913 A 7/1996 Asbach et al.
5,558,254 A 9/1996 Anderson et al.
5,560,283 A 10/1996 Hannig
5,584,412 A 12/1996 Wang
D377,554 S 1/1997 Adriaansen
5,611,507 A 3/1997 Smith
5,628,424 A 5/1997 Gola
5,632,401 A 5/1997 Hurd
5,636,416 A 6/1997 Anderson
5,636,761 A 6/1997 Diamond et al.
5,644,111 A 7/1997 Cerny et al.
5,645,186 A 7/1997 Powers et al.
5,650,680 A 7/1997 Chula
D383,277 S 9/1997 Peters
5,662,235 A 9/1997 Nieto
5,671,847 A 9/1997 Pedersen et al.
5,690,247 A 11/1997 Boover
5,695,088 A 12/1997 Kasbohm
5,699,929 A 12/1997 Ouno
D388,922 S 1/1998 Peters
D389,631 S 1/1998 Peters
5,704,511 A 1/1998 Kellams
5,724,837 A 3/1998 Shin
5,730,312 A 3/1998 Hung
5,732,845 A 3/1998 Armaly, Jr.
5,735,495 A 4/1998 Kubota
5,738,239 A 4/1998 Triglia
5,770,935 A * 6/1998 Smith ..... B65F 1/1638 220/211
5,799,909 A 9/1998 Ziegler
5,816,431 A 10/1998 Giannopoulos
5,816,640 A 10/1998 Nishimura
D401,383 S 11/1998 Gish
D401,719 S 11/1998 Van Leeuwen et al.
5,873,643 A 2/1999 Burgess, Jr. et al.
5,881,896 A 3/1999 Presnell et al.
5,881,901 A 3/1999 Hampton
5,884,237 A 3/1999 Kanki et al.
5,887,748 A 3/1999 Nguyen
D412,552 S 8/1999 Burrows
5,961,105 A 10/1999 Ehrnsberger et al.
5,967,392 A 10/1999 Niemi et al.
5,987,708 A 11/1999 Newton
6,000,569 A 12/1999 Liu
6,010,024 A 1/2000 Wang
6,024,238 A 2/2000 Jaros
6,036,050 A 3/2000 Ruane
6,102,239 A 8/2000 Wien
6,105,859 A 8/2000 Stafford
6,123,215 A 9/2000 Windle
D431,700 S 10/2000 Roudebush
6,126,031 A 10/2000 Reason
6,129,233 A 10/2000 Schiller
6,131,861 A 10/2000 Fortier, Jr. et al.
D435,951 S 1/2001 Yang et al.
6,209,744 B1 4/2001 Gill
6,211,637 B1 4/2001 Studer
6,234,339 B1 5/2001 Thomas
6,250,492 B1 6/2001 Verbeek
D445,980 S 7/2001 Tjugum
6,286,706 B1 9/2001 Tucker
6,328,320 B1 12/2001 Walski et al.
6,345,725 B1 2/2002 Lin
6,364,147 B1 4/2002 Meinzinger et al.
6,386,386 B1 5/2002 George
6,390,321 B1 5/2002 Wang
6,401,958 B1 6/2002 Foss et al.
6,519,130 B1 2/2003 Breslow
6,557,716 B1 5/2003 Chan
D476,456 S 6/2003 Englert et al.
6,596,983 B2 7/2003 Brent
6,626,316 B2 9/2003 Yang
6,626,317 B2 9/2003 Pfiefer et al.
6,632,064 B1 10/2003 Walker et al.
D481,846 S 11/2003 Lin
D482,169 S 11/2003 Lin
6,659,407 B2 12/2003 Asaro
6,681,950 B2 1/2004 Miller, Jr. et al.
D488,604 S 4/2004 Yang et al.
D488,903 S 4/2004 Yang et al.
D489,503 S 5/2004 Lin
D489,857 S 5/2004 Yang et al.
D490,583 S 5/2004 Yang et al.
D490,954 S 6/2004 Brand
D491,706 S 6/2004 Yang et al.
6,758,366 B2 7/2004 Bourgund et al.
D493,930 S 8/2004 Wang
D494,723 S 8/2004 Lin
6,812,655 B1 11/2004 Wang et al.
6,814,249 B2 11/2004 Lin
D499,450 S 12/2004 Goodman et al.
6,837,393 B1 1/2005 Kuo
6,857,538 B2 2/2005 Lin
6,859,005 B2 * 2/2005 Boliver ..... B65F 1/1638 220/200
D503,021 S 3/2005 Yang et al.
6,866,826 B2 3/2005 Moore et al.
6,883,676 B2 4/2005 Lin
D507,090 S 7/2005 Yang et al.
6,920,994 B2 7/2005 Lin
6,974,948 B1 12/2005 Brent
D513,445 S 1/2006 Lin
6,981,606 B2 1/2006 Yang et al.
D517,764 S 3/2006 Wang
D517,767 S 3/2006 Yang et al.
D518,266 S 3/2006 Yang et al.
7,017,773 B2 3/2006 Gruber et al.
7,044,323 B2 5/2006 Yang
D525,756 S 7/2006 Yang et al.
7,073,677 B2 7/2006 Richardson et al.
7,077,283 B2 7/2006 Yang et al.
7,080,750 B2 7/2006 Wein et al.
7,086,550 B2 8/2006 Yang et al.
D528,726 S 9/2006 Lin
7,121,421 B2 10/2006 Yang et al.
D531,499 S 11/2006 Zaidman
D535,799 S 1/2007 Epps
D535,800 S 1/2007 Yang et al.
7,163,591 B2 1/2007 Kim et al.
7,168,591 B1 1/2007 Miller
D537,223 S 2/2007 Lin
D537,599 S 2/2007 Lin
D537,601 S 2/2007 Lin
D537,999 S 3/2007 Lin
D538,995 S 3/2007 Lin
D539,498 S 3/2007 Yang et al.
D539,499 S 3/2007 Yang et al.
D540,001 S 4/2007 Zimmerman
D542,001 S 5/2007 Yang et al
D542,995 S 5/2007 Lin
D543,673 S 5/2007 Yang et al.
D544,170 S 6/2007 Lin
D544,171 S 6/2007 Lin
D544,671 S 6/2007 Saunders et al.
D545,024 S 6/2007 Liao
7,225,943 B2 6/2007 Yang et al.
D547,020 S 7/2007 Chen
7,243,811 B1 7/2007 Ramsey
D550,918 S 9/2007 Wang et al.
D552,319 S 10/2007 Gusdorf
D552,321 S 10/2007 Yang et al.
D552,823 S 10/2007 Yang et al.
D552,824 S 10/2007 Zimmerman
D552,825 S 10/2007 Yang et al.
D555,320 S 11/2007 Yang et al.
D559,494 S 1/2008 Yang et al.
D559,495 S 1/2008 Yang et al.

(56) References Cited

U.S. PATENT DOCUMENTS

D562,522 S 2/2008 Daams
7,328,842 B2 2/2008 Wagner et al.
D564,169 S 3/2008 Wang
D564,723 S 3/2008 Yang et al.
D566,367 S 4/2008 Lin
D566,369 S 4/2008 Shek
D566,923 S 4/2008 Lin
D567,468 S 4/2008 Yang et al.
D568,572 S 5/2008 Yang et al.
D569,720 S 5/2008 Lablaine
7,374,060 B2 5/2008 Yang et al.
D571,520 S 6/2008 Lin
7,395,990 B1 7/2008 Stevens
7,398,913 B2 7/2008 McClure
7,404,499 B1 7/2008 Ramsey
D574,569 S 8/2008 Yang et al.
D576,371 S 9/2008 Zimmerman
D578,265 S 10/2008 Presnell
D578,266 S 10/2008 Yang et al.
D578,268 S 10/2008 Yang et al.
D578,722 S 10/2008 Yang et al.
7,438,199 B1 10/2008 Tidrick
D580,120 S 11/2008 Lin
D580,613 S 11/2008 Yang et al.
D580,615 S 11/2008 Yang et al.
D581,622 S 11/2008 Presnell et al.
D584,470 S 1/2009 Bizzell et al.
D585,171 S 1/2009 Bizzell et al.
D585,618 S 1/2009 Yang et al.
D586,070 S 2/2009 Lin
7,494,021 B2 2/2009 Yang et al.
D587,874 S 3/2009 Lin
D593,271 S 5/2009 Yang et al.
7,540,396 B2 6/2009 Yang et al.
7,543,716 B2 6/2009 Lin
7,559,433 B2 7/2009 Yang et al.
D599,074 S 8/2009 Bizzell et al.
D603,119 S 10/2009 Yang et al.
7,607,552 B2 10/2009 Efstathiou
D604,472 S 11/2009 Blanks et al.
7,614,519 B2 11/2009 Krauth et al.
7,621,420 B2 11/2009 Bandoh et al.
7,656,109 B2 2/2010 Yang et al.
D611,216 S 3/2010 Yang et al.
D611,217 S 3/2010 Bizzell et al.
D611,671 S 3/2010 Yang et al.
7,694,838 B2 4/2010 Yang et al.
7,703,622 B1 4/2010 Bynoe
D615,270 S 5/2010 Yang et al.
D615,722 S 5/2010 Yang et al.
7,712,285 B2 5/2010 Stravitz et al.
7,741,801 B2 6/2010 Fukuizumi
7,748,556 B2 7/2010 Yang et al.
7,781,995 B2 8/2010 Yang et al.
D623,817 S 9/2010 Yang et al.
D625,068 S 10/2010 Shannon
7,806,285 B2 10/2010 Yang et al.
D627,533 S 11/2010 Yang et al.
D627,944 S 11/2010 Wang et al.
D629,172 S 12/2010 Liao
D630,404 S 1/2011 Yang et al.
D631,221 S 1/2011 Yang et al.
D632,864 S 2/2011 Yang et al.
D634,911 S 3/2011 Yang et al.
D635,319 S 3/2011 Meyerhoffer
7,896,187 B2 3/2011 Haibel
7,922,024 B2 4/2011 Yang et al.
7,950,543 B2 5/2011 Yang et al.
D644,390 S 8/2011 Smeets et al.
7,992,742 B1 8/2011 Kim
8,006,857 B2 8/2011 Lin
D644,806 S 9/2011 Yang et al.
D644,807 S 9/2011 Yang et al.
D649,728 S 11/2011 Campbell
8,074,833 B2 12/2011 Yang et al.
8,096,445 B2 1/2012 Yang et al.
D655,061 S 2/2012 Scaturro
8,136,688 B2 3/2012 Lee et al.
D657,108 S 4/2012 Yang et al.
D657,109 S 4/2012 Liao
8,297,470 B2 10/2012 Yang et al.
8,317,055 B2 11/2012 Zawrotny et al.
D672,520 S 12/2012 Yang et al.
D673,750 S 1/2013 Quan
D675,802 S 2/2013 Yang et al.
D675,803 S 2/2013 Yang et al.
8,418,869 B2 4/2013 Yang et al.
D689,255 S 9/2013 Sun Ting Kung et al.
8,567,630 B2 10/2013 Yang et al.
8,569,980 B2 10/2013 Yang et al.
8,575,537 B2 11/2013 Yao et al.
8,672,171 B2 3/2014 Wynn et al.
8,678,219 B1 3/2014 Wang et al.
8,686,676 B2 4/2014 Yang et al.
D704,406 S 5/2014 Kern
8,716,969 B2 5/2014 Yang et al.
8,720,728 B2 5/2014 Yang et al.
8,766,582 B2 7/2014 Yang et al.
8,807,378 B2 8/2014 Kaberna
8,807,379 B1 8/2014 Hammond
D714,510 S 9/2014 Yang et al.
D715,575 S 10/2014 Williams et al.
D716,015 S 10/2014 van de Leest
8,851,316 B2 10/2014 Barrett et al.
8,872,459 B2 10/2014 Yang et al.
D725,860 S 3/2015 Spivey et al.
D725,861 S 3/2015 Yang et al.
D730,008 S 5/2015 Yang et al.
9,051,093 B2 6/2015 Yang et al.
D755,461 S 5/2016 Wall
D759,934 S 6/2016 Yang et al.
D762,037 S 7/2016 Chen
D765,937 S 9/2016 Chen
D766,998 S 9/2016 Kao et al.
9,434,538 B2 9/2016 Yang et al.
D771,344 S 11/2016 Yang et al.
D773,145 S 11/2016 Yang et al.
9,481,515 B2 11/2016 Yang et al.
9,573,759 B2 2/2017 Yang et al.
9,586,755 B1 3/2017 Yang et al.
2001/0002690 A1 6/2001 Rosky
2001/0020619 A1 9/2001 Pfeifer et al.
2001/0045512 A1 11/2001 Brent
2002/0066736 A1 6/2002 Pyles
2002/0092853 A1 7/2002 Wang
2002/0096523 A1 7/2002 Pyles
2002/0096524 A1 7/2002 Hardesty
2002/0104266 A1 8/2002 Ranaudo
2002/0116924 A1 8/2002 Winkelmann et al.
2003/0089719 A1 5/2003 Berger
2003/0102316 A1 6/2003 Forest
2003/0201265 A1 10/2003 Lin
2003/0205979 A1* 11/2003 Papari ..... B65F 1/1638 318/466
2003/0230576 A1 12/2003 Lin
2004/0016756 A1 1/2004 Lin
2004/0134924 A1 7/2004 Hansen et al.
2004/0140782 A1 7/2004 Okabe et al.
2004/0164077 A1 8/2004 Kuo
2004/0174268 A1 9/2004 Scott et al.
2004/0175303 A1 9/2004 Lin
2004/0199401 A1 10/2004 Wagner
2004/0200938 A1 10/2004 Forlivio
2004/0206758 A1 10/2004 Lin
2004/0206760 A1 10/2004 Gagnebin
2004/0251746 A1 12/2004 Ichimaru et al.
2005/0017006 A1 1/2005 Kuo
2005/0017010 A1 1/2005 Siegel et al.
2005/0029281 A1 2/2005 Westermann et al.
2005/0129803 A1 6/2005 Umeda et al.
2005/0258177 A1 11/2005 Woodson
2005/0258794 A1 11/2005 Fukuizumi
2006/0027579 A1 2/2006 Yang et al.
2006/0103086 A1 5/2006 Niemeyer et al.

(56) References Cited

U.S. PATENT DOCUMENTS

| | | | | |
|---|---|---|---|---|
| 2006/0138149 | A1 | 6/2006 | Tracy | |
| 2006/0163257 | A1 | 7/2006 | Golbert | |
| 2006/0175336 | A1 | 8/2006 | Wang | |
| 2006/0186121 | A1 | 8/2006 | Yang et al. | |
| 2006/0196874 | A1 | 9/2006 | Yang | |
| 2006/0237641 | A1 | 10/2006 | Moeller et al. | |
| 2006/0249510 | A1 | 11/2006 | Lin | |
| 2006/0278643 | A1 | 12/2006 | Chiou | |
| 2007/0012699 | A1 | 1/2007 | Yang et al. | |
| 2007/0034334 | A1 | 2/2007 | Ramsey et al. | |
| 2007/0045326 | A1 | 3/2007 | Tramontina et al. | |
| 2007/0090112 | A1 | 4/2007 | Kalman et al. | |
| 2007/0114847 | A1 | 5/2007 | Ichimaru et al. | |
| 2007/0181579 | A1 | 8/2007 | Kuo et al. | |
| 2007/0209846 | A1 | 9/2007 | Wilson | |
| 2007/0215622 | A1 | 9/2007 | Perez | |
| 2007/0241109 | A1 | 10/2007 | Lin | |
| 2007/0266637 | A1 | 11/2007 | McGowan | |
| 2007/0272691 | A1 | 11/2007 | Wang et al. | |
| 2007/0289972 | A1 | 12/2007 | Wynn et al. | |
| 2008/0011754 | A1 | 1/2008 | Ramsey | |
| 2008/0011910 | A1 | 1/2008 | Ramsey | |
| 2008/0041863 | A1 | 2/2008 | Forest | |
| 2008/0083756 | A1 | 4/2008 | Daniels | |
| 2008/0083757 | A1 | 4/2008 | Parker et al. | |
| 2008/0099274 | A1 | 5/2008 | Seel | |
| 2008/0128428 | A1 | 6/2008 | Beckerman | |
| 2008/0164257 | A1 | 7/2008 | Boll et al. | |
| 2008/0236275 | A1 | 10/2008 | Breed et al. | |
| 2008/0257889 | A1 | 10/2008 | Kovacevich et al. | |
| 2008/0257890 | A1 | 10/2008 | Kovacevich et al. | |
| 2008/0257891 | A1 | 10/2008 | Kovacevich et al. | |
| 2008/0264948 | A1 | 10/2008 | Kovacevich et al. | |
| 2008/0264950 | A1 | 10/2008 | Kovacevich et al. | |
| 2008/0272119 | A1 | 11/2008 | Efstathiou | |
| 2008/0272127 | A1 | 11/2008 | Kovacevich et al. | |
| 2009/0084788 | A1 | 4/2009 | Yang et al. | |
| 2009/0136341 | A1 | 5/2009 | Kenyon | |
| 2009/0230131 | A1 | 9/2009 | McDuffie et al. | |
| 2009/0261105 | A1* | 10/2009 | Cunningham | B65F 1/068 220/495.08 |
| 2009/0266836 | A1 | 10/2009 | Mobley | |
| 2010/0006572 | A1* | 1/2010 | Chiou | B65F 1/1607 220/263 |
| 2010/0084235 | A1 | 4/2010 | Lu | |
| 2010/0096894 | A1 | 4/2010 | Fukai | |
| 2010/0122985 | A1 | 5/2010 | Peters et al. | |
| 2010/0147865 | A1 | 6/2010 | Yang et al. | |
| 2010/0170904 | A1 | 7/2010 | Kalman et al. | |
| 2010/0237074 | A1 | 9/2010 | Yang et al. | |
| 2010/0252557 | A1 | 10/2010 | Clements | |
| 2010/0294769 | A1 | 11/2010 | Lee et al. | |
| 2011/0017735 | A1* | 1/2011 | Wang | B65F 1/1607 220/211 |
| 2011/0049149 | A1* | 3/2011 | Shih | B65F 1/1607 220/260 |
| 2011/0056952 | A1 | 3/2011 | Borowski et al. | |
| 2011/0139781 | A1 | 6/2011 | Jin et al. | |
| 2011/0220646 | A1* | 9/2011 | Yang | B65F 1/1638 220/211 |
| 2011/0220647 | A1* | 9/2011 | Yang | B65F 1/1638 220/211 |
| 2011/0220648 | A1* | 9/2011 | Yang | B65F 1/1638 220/211 |
| 2011/0220655 | A1 | 9/2011 | Yang et al. | |
| 2011/0272409 | A1 | 11/2011 | Kasbohm | |
| 2012/0234849 | A1 | 9/2012 | Hughes et al. | |
| 2012/0261423 | A1 | 10/2012 | Zawrotny et al. | |
| 2013/0098913 | A1 | 4/2013 | Yang et al. | |
| 2013/0105487 | A1 | 5/2013 | Baik | |
| 2013/0233857 | A1 | 9/2013 | Yang et al. | |
| 2013/0240592 | A1 | 9/2013 | Woodruff | |
| 2013/0248532 | A1 | 9/2013 | Yang et al. | |
| 2013/0248535 | A1 | 9/2013 | Wolfe et al. | |
| 2013/0300119 | A1 | 11/2013 | Anzalon et al. | |
| 2014/0183193 | A1 | 7/2014 | Hammond et al. | |
| 2014/0246432 | A1 | 9/2014 | Yang et al. | |
| 2014/0246434 | A1 | 9/2014 | Yang et al. | |
| 2014/0345453 | A1 | 11/2014 | Oh et al. | |
| 2015/0251849 | A1 | 9/2015 | Yang et al. | |
| 2015/0259139 | A1 | 9/2015 | Yang et al. | |
| 2015/0321841 | A1 | 11/2015 | Salas et al. | |

FOREIGN PATENT DOCUMENTS

| | | | |
|---|---|---|---|
| CN | 201105898 | Y | 8/2008 |
| CN | 201512253 | U | 6/2010 |
| DE | 1610087 | | 7/1950 |
| DE | 822376 | | 11/1951 |
| DE | 1283741 | | 7/1966 |
| DE | 8436939 | | 3/1985 |
| DE | 4225936 | | 2/1994 |
| DE | 19525885 | | 3/1997 |
| DE | 19617823 | | 11/1997 |
| DE | 19809331 | | 5/1999 |
| DE | 19933180 | | 1/2001 |
| DE | 10148997 | | 4/2003 |
| DE | 20217561 | | 3/2004 |
| DE | 10337806 | A1 | 3/2005 |
| EP | 0582240 | | 7/1993 |
| EP | 0903305 | A1 | 3/1999 |
| EP | 0906876 | A2 | 4/1999 |
| EP | 1094017 | A1 | 4/2001 |
| EP | 1361176 | A1 | 11/2003 |
| EP | 1447342 | A2 | 8/2004 |
| EP | 1600373 | A2 | 11/2005 |
| EP | 1647503 | A1 | 4/2006 |
| EP | 1686073 | A1 | 8/2006 |
| EP | 1918223 | A1 | 5/2008 |
| EP | 2343250 | A1 | 7/2011 |
| EP | 2364932 | B1 | 4/2016 |
| FR | 2887152 | | 12/2006 |
| GB | 191004921 | | 6/1910 |
| GB | 2384418 | | 7/2003 |
| JP | 02-152670 | | 6/1990 |
| JP | H06-56011 | | 8/1994 |
| JP | 06-272888 | | 9/1994 |
| JP | 2004-106713 | | 4/2004 |
| JP | 2004-231237 | | 8/2004 |
| JP | D1300450 | | 5/2007 |
| JP | D1300451 | | 5/2007 |
| JP | D1322056 | | 2/2008 |
| JP | D1550907 | | 4/2016 |
| JP | D1551184 | | 4/2016 |
| WO | WO 92/02430 | A1 | 2/1992 |
| WO | WO 96/33671 | | 10/1996 |
| WO | WO 2005/080232 | A1 | 9/2005 |
| WO | WO 2006/079263 | A1 | 8/2006 |
| WO | WO 2009/114495 | A1 | 9/2009 |
| WO | WO 2015/134902 | A1 | 9/2015 |
| WO | WO 2015/138625 | A1 | 9/2015 |
| WO | WO 2016/054109 | A1 | 4/2016 |

OTHER PUBLICATIONS

U.S. Appl. No. 29/484,903, filed Mar. 13, 2014, Yang et al.
U.S. Appl. No. 14/637,270, filed Mar. 4, 2015, Yang et al.
U.S. Appl. No. 14/639,049, filed Mar. 4, 2015, Yang et al.
U.S. Appl. No. 29/519,549, filed Mar. 5, 2015, Yang et al.
U.S. Appl. No. 29/519,551, filed Mar. 5, 2015, Yang et al.
Trento Corner 23 Trash Can, Hailo product webpage, May 2008, http://www.hailo.de/html/default.asp?site=12_71_107&lang=en.
U.S. Appl. No. 14/707,978, filed May 8, 2015, To Be Determined.
Search Report for Taiwanese Design Application No. 103305382, dated May 12, 2015, in 4 pages.
International Search Report and Written Opinion in corresponding International Application No. PCT/US2015/19997, mailed Jul. 28, 2015, 13 pages.
U.S. Appl. No. 14/856,309, filed Sep. 26, 2015, Yang et al.
U.S. Appl. No. 29/548,018, filed Dec. 9, 2015, Yang et al.
U.S. Appl. No. 29/557,032, filed Mar. 4, 2016, Yang et al.

(56) References Cited

OTHER PUBLICATIONS

U.S. Appl. No. 29/557,088, filed Mar. 4, 2016, Yang et al.
U.S. Appl. No. 29/563,650, filed May 6, 2016, Yang et al.
U.S. Appl. No. 15/265,455, filed Sep. 14, 2016, To Be Determined.
U.S. Appl. No. 29/584,385, filed Nov. 14, 2016, Yang et al.
Simplehuman Liner Rim Dual Bucket Rectangular Recycler with Liner Pocket, Stainless Steel, 58 Liter / 15 Gallon, Item No. CW2025, www.Amazon.com, site visited Dec. 29, 2015.
International Preliminary Report on Patentability in corresponding International Application No. PCT/US2015/19997, mailed Sep. 22, 2016, 9 pages.
U.S. Appl. No. 15/265,455.
U.S. Appl. No. 29/584,385.
U.S. Appl. No. 29/484,903.
U.S. Appl. No. 14/637,270.
U.S. Appl. No. 14/639,049.
U.S. Appl. No. 29/519,549.
U.S. Appl. No. 29/519,551.
U.S. Appl. No. 14/707,978.

* cited by examiner

DUAL SENSING RECEPTACLES

CROSS-REFERENCE TO RELATED APPLICATIONS

This application claims the benefit of priority to U.S. Provisional Patent Application No. 61/953,402, filed Mar. 14, 2014, and entitled "DUAL SENSING RECEPTACLE." The disclosure of this prior application is considered part of, and is incorporated by reference in, this application in its entirety.

BACKGROUND

Field

The present disclosure relates to receptacle assemblies, particularly to trashcan assemblies having power-operated lids.

Description of the Related Art

Receptacles having a lid are used in a variety of different settings. For example, in both residential and commercial settings, trashcans often have lids for preventing the escape of contents or odors from the trashcan. Recently, trashcans with power-operated lids have become commercially available. Such trashcans can include a sensor that can trigger the trashcan lid to open.

SUMMARY

In sensor-activated receptacles, it can be difficult to calibrate the sensor to trigger lid movement only when the user intends to open the lid. If the sensor is too sensitive, the sensor can trigger lid movement nearly every time a person walks by the receptacle. This accidental lid movement will quickly exhaust the power source and/or wear down components from over use (e.g., the motor). Further, if the sensor is not adaptable, an accidental or unintended lid movement may occur due to a stationary or static object (e.g., a piece of furniture) that triggers the sensor. However, if the sensor is calibrated to be less sensitive, it can be difficult to trigger lid movement.

Certain aspects of the disclosure are directed toward a trashcan assembly having a lid portion pivotably coupled with a body portion. The trashcan assembly can include a sensor assembly that can generate a signal when an object is detected within a sensing region. The sensor assembly can include a plurality of transmitters having a first subset of transmitters and a second subset of transmitters. Each of these subsets of transmitters can include one or more transmitters. A transmission axis of at least one transmitter in the first subset of transmitters can be different from a transmission axis of at least one of the transmitters in the second subset of transmitters. An electronic processor can generate an electronic signal to a power-operated drive mechanism for moving the lid portion from a closed position to an open position when the sensor assembly detects the object within the sensing region. In some embodiments, the sensor assembly can be coupled to a trim ring portion. The trim ring portion can engage an upper edge of the body portion. In some embodiments, the sensor assembly can include a lens covering having a front surface and an upper surface. The front surface of the lens covering can be substantially flush with, and/or be shaped to generally match or correspond to the shape of, a front surface of the trim ring portion, and the upper surface of the tens covering can be substantially flush with, and/or be shaped to generally match or correspond to the shape of, an upper surface of the trim ring portion.

Any of the trashcan assembly features or structures disclosed in this specification can be included in any embodiment. In some embodiments, each transmitter in the first subset of transmitters can have a transmission axis extending generally outward from a front surface of the sensor assembly (e.g., in front of the trashcan assembly, such as about 45 degrees from a top surface of the trashcan assembly), and each transmitter in the second subset of transmitters can have a transmission axis extending generally upward from an upper surface of the sensor assembly. In some embodiments, the transmission axes of the first subset of transmitters can be generally parallel. In some embodiments, the first subset of transmitters includes a greater number of transmitters than the second subset of transmitters. For example, the first subset can include a plurality of transmitters (e.g., two, three, or more) and the second subset can include a single transmitter. In some embodiments, there are more transmitters than receivers. For example, the sensor assembly can include a single receiver and multiple transmitters.

Certain aspects of the disclosure are directed toward a trashcan assembly having a lid portion pivotably coupled with a body portion. The trashcan assembly can include a sensor assembly configured to detect an object within a sensing region having an upward-directed portion and an outward-directed portion extending in a direction different from the upward-directed portion. An electronic processor can generate an electronic signal to a power-operated drive mechanism for moving the lid portion from a closed position to an open position when the sensor assembly detects the object within the sensing region.

In some embodiments, a range of the upward-directed portion can be substantially the same as a range of the outward-directed portion of the sensing region. In some embodiments, a width of the sensing region can extend across at least a majority of a width of the trashcan assembly, or about the entire width of the trashcan assembly, or at least about the entire width of the trashcan assembly, or more than the entire width of the trashcan assembly. In some embodiments, the sensing region can form a beam angle of at least about 60 degrees. The beam angle can be measured from an outer periphery of the sensing region to a central axis of the sensing region. In some embodiments, the sensing region can include a ready-mode region and a hyper-mode region extending beyond the ready-mode region. The sensor assembly can be configured to detect the object within the hyper-mode region after or only after the object is detected within the ready-mode region. In certain embodiments, an upward-directed range of the ready-mode region can be greater than an outward-directed range of the ready-mode region.

Certain aspects of the disclosure are directed toward a method of manufacturing a trashcan assembly. The method can include pivotably coupling a lid portion to a body portion. The method can include configuring a sensor assembly to generate a signal when an object is detected within a sensing region. The sensor assembly can include any of the features described in this specification. The method can include configuring an electronic processor to generate an electronic signal to a power-operated drive mechanism for moving the lid portion from a closed position to an open position when the sensor assembly detects the object within the sensing region. In some embodiments, the method can include coupling the sensor assembly to a trim ring portion and engaging the trim ring portion with an upper edge of the body portion.

In some embodiments, a trashcan assembly can comprise: a body portion positioned in an environment; a lid portion pivotably coupled with the body portion; a sensor assembly configured to create at least one sensing region, such that the sensor assembly is configured to detect a change in at least a portion of the environment within the sensing region; and an electronic processor comprising a software module configured to generate an electronic signal to a power-operated drive mechanism for moving the lid portion from a closed position to an open position when the sensor assembly detects an object located within the portion of the environment, wherein the software module provides one or more adaptable sensing conditions that can be modified based on one or more changes in the portion of the environment. In some embodiments, a trashcan assembly can comprise: a body portion configured to be surrounded by an environment; a lid portion pivotably coupled with the body portion; a sensor assembly configured to create one or more sensing regions, such that the sensor assembly is configured to detect changes in at least a portion of the environment within the sensing region; a computer-readable memory storing executable instructions; and one or more physical processors in communication with the computer-readable memory, wherein the one or more physical processors are programmed by the executable instructions to at least: measure a present state of the portion of the environment located in each sensing region; determine whether the portion of environment of each sensing region is stable, the determination being based on a stability threshold for each sensing region; adjust a sensing threshold corresponding to at least one of the plurality of sensing regions, the adjustment being based on a calibrated value and an environmental measurement for the corresponding sensing region; and send an electric signal to operate the lid portion of the trashcan assembly from a closed position to an open position when an object is detected within at least one sensing region, based in part on the detection of the object exceeding the adjusted sensing threshold.

Any feature, structure, or step disclosed herein can be replaced with or combined with any other feature, structure, or step disclosed herein, or omitted. Further, for purposes of summarizing the disclosure, certain aspects, advantages, and features of the inventions have been described herein. It is to be understood that not necessarily any or all such advantages are achieved in accordance with any particular embodiment of the inventions disclosed herein. No individual aspects of this disclosure are essential or indispensable.

BRIEF DESCRIPTION OF THE DRAWINGS

Various embodiments are depicted in the accompanying drawings for illustrative purposes, and should in no way be interpreted as limiting the scope of the embodiments. Furthermore, various features of different disclosed embodiments can be combined to form additional embodiments, which are part of this disclosure.

DETAILED DESCRIPTION

Figure 1:
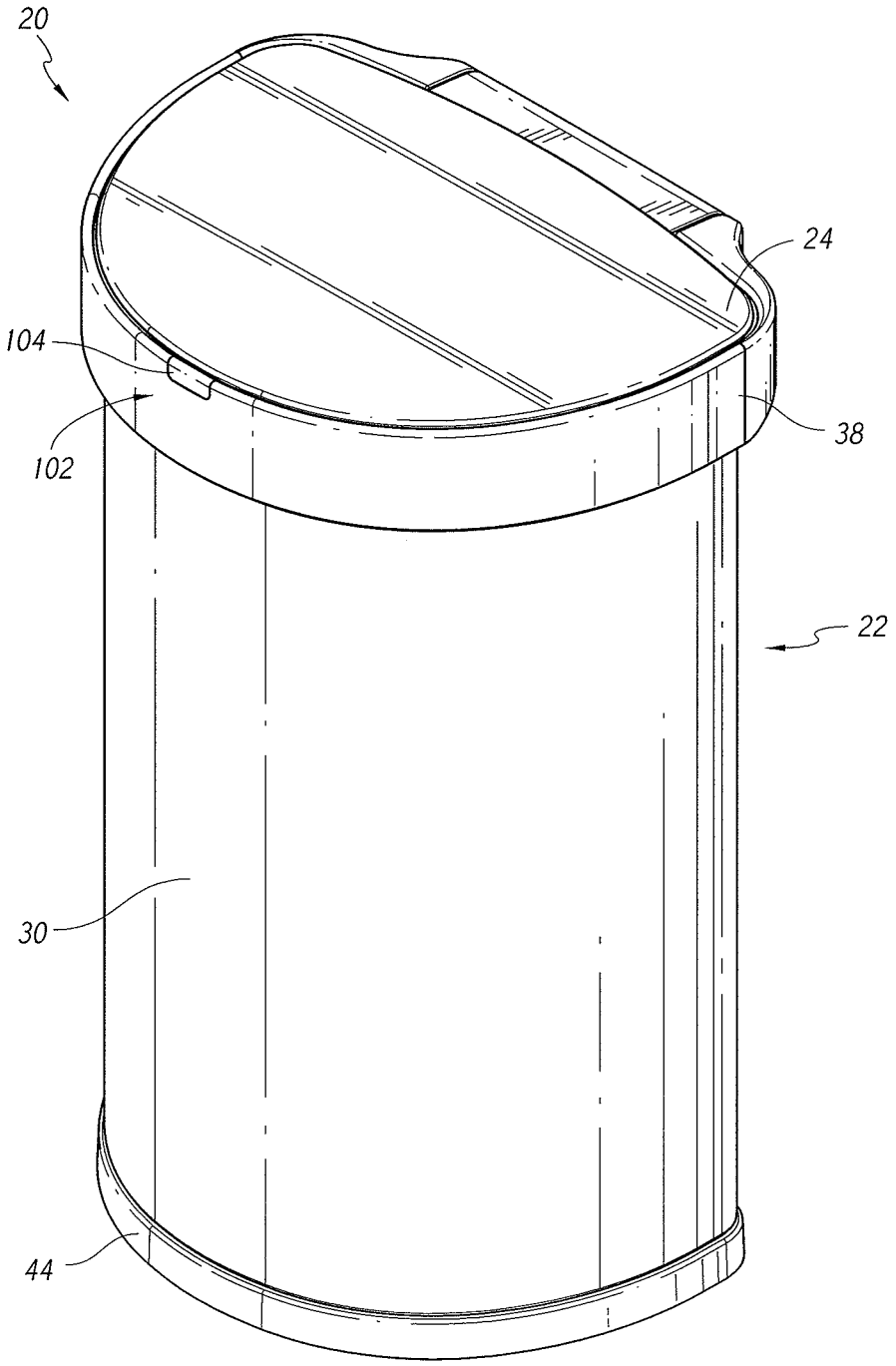
FIG. 1 illustrates a front perspective view of an embodiment of a receptacle assembly.
Figure 2:
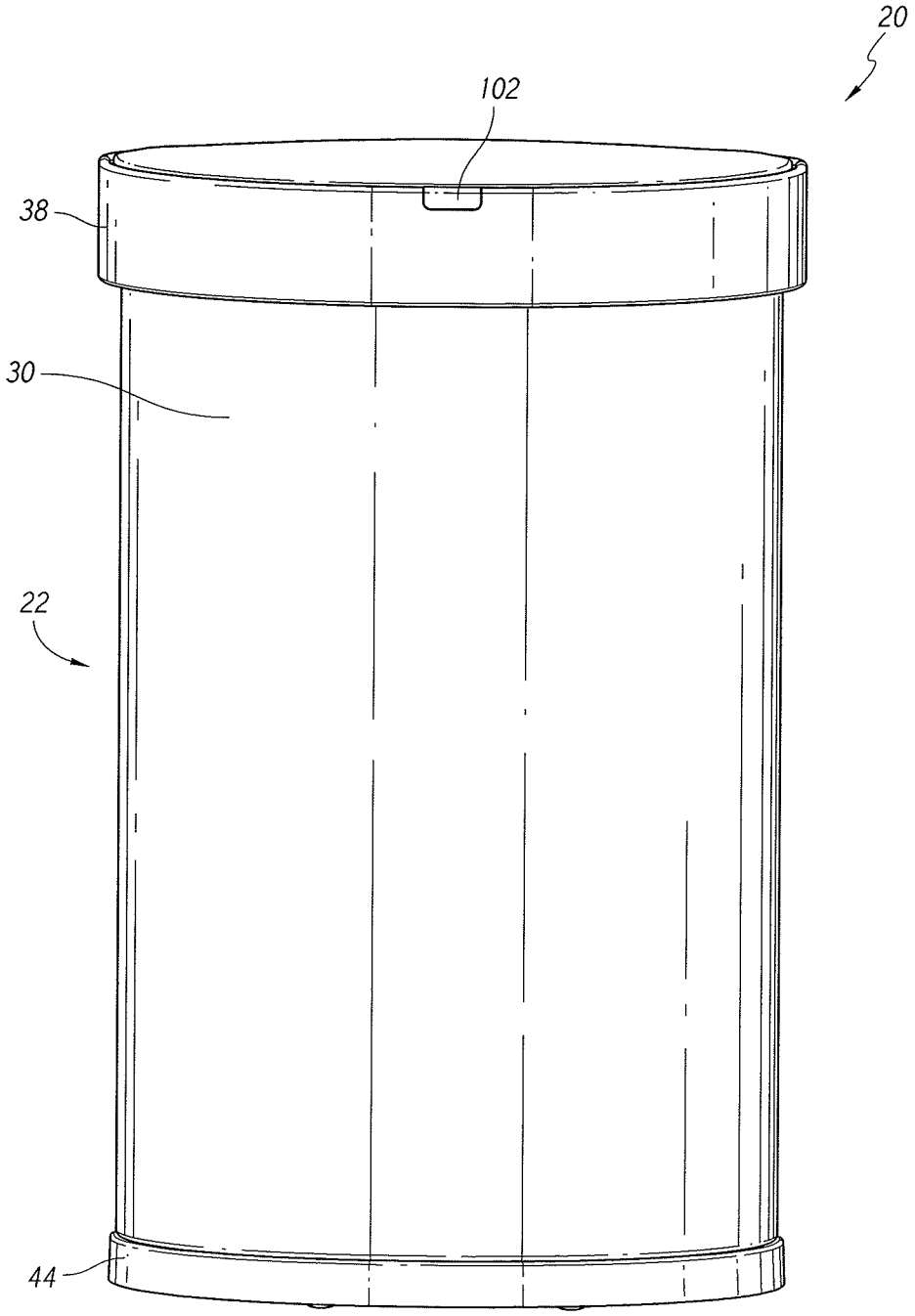
FIG. 2 illustrates a front elevation view of the receptacle assembly shown in FIG. 1.
Figure 3:
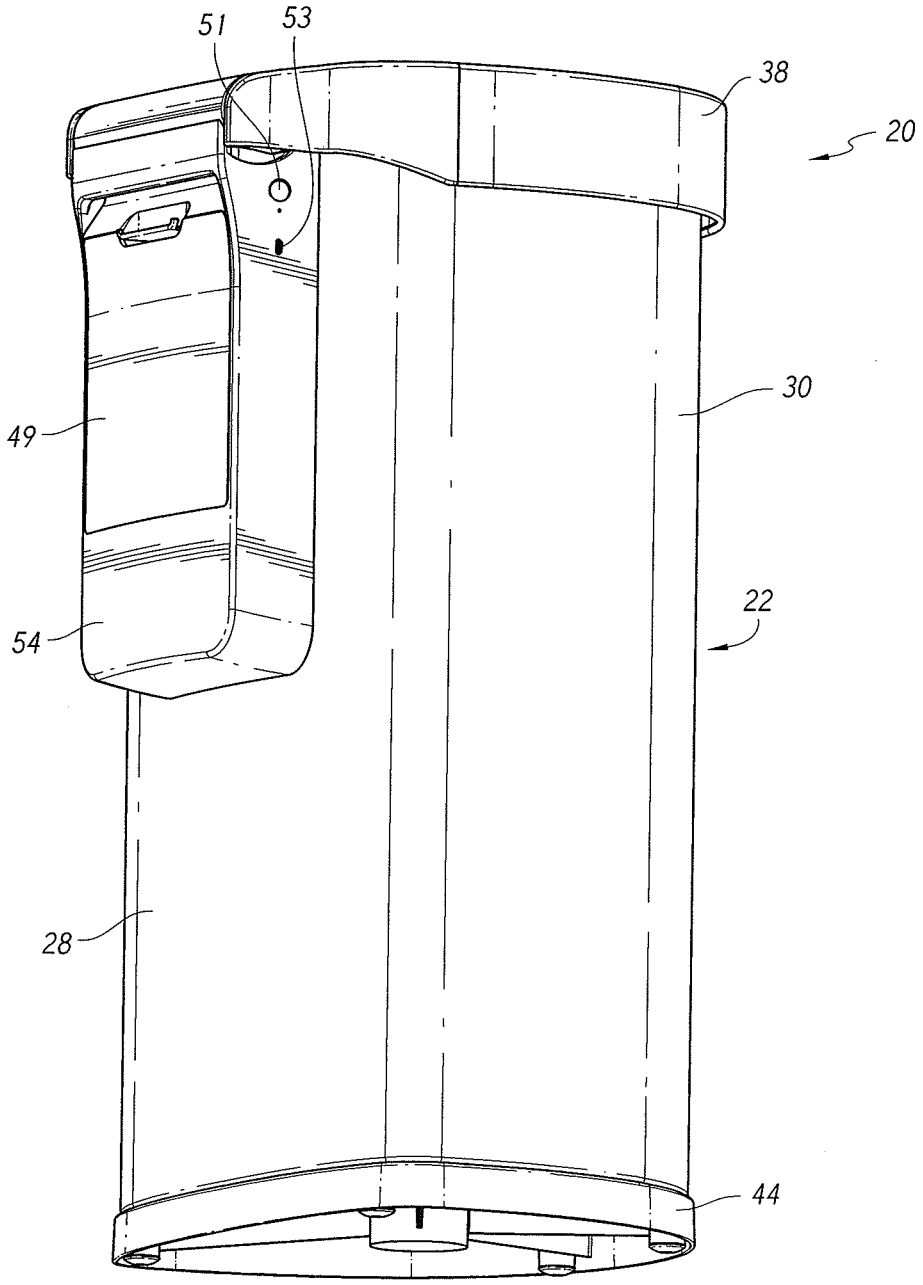
FIG. 3 illustrates a rear perspective view of the receptacle assembly shown in FIG. 1.
Figure 4:
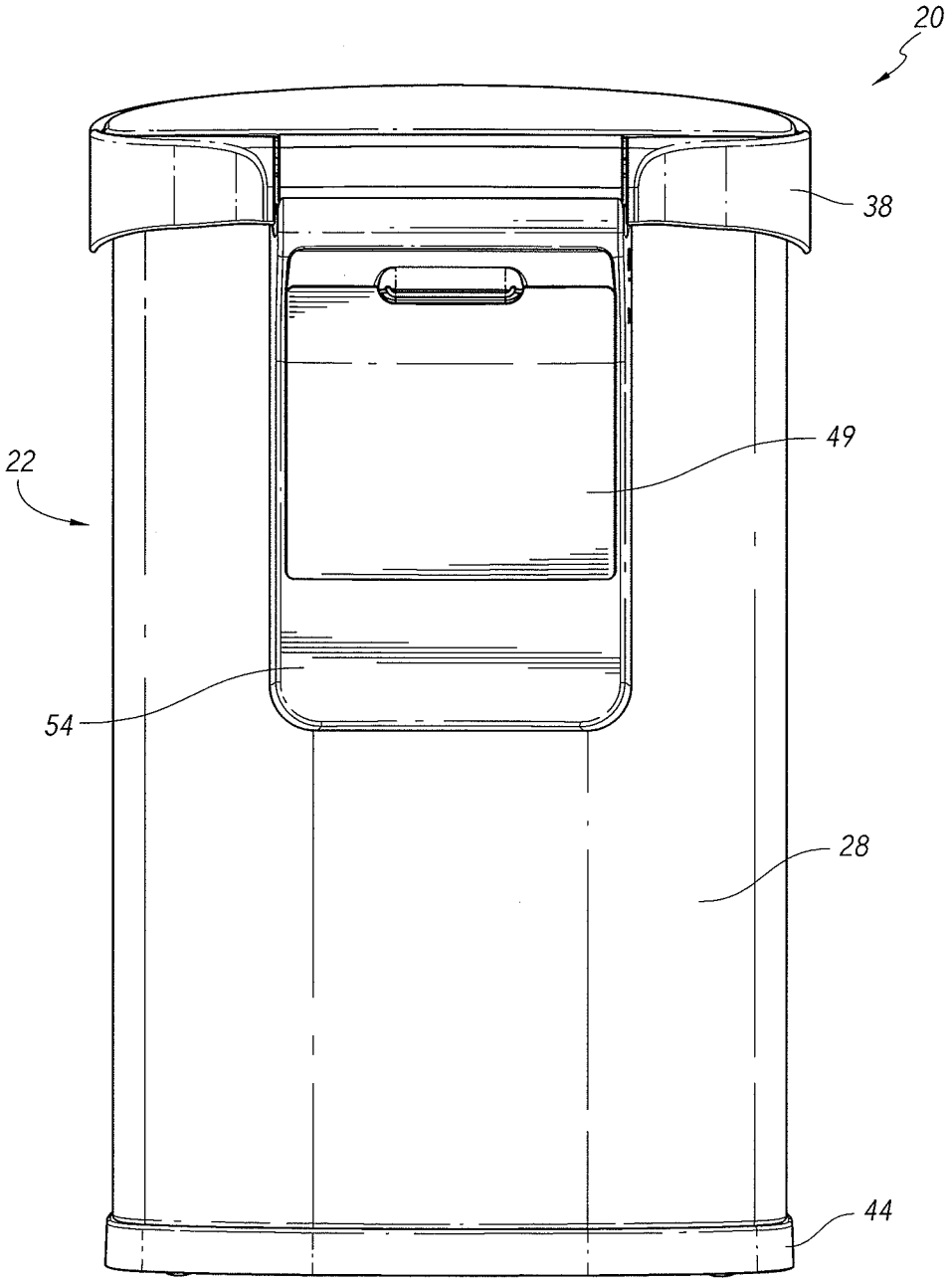
FIG. 4 illustrates a rear elevation view of the receptacle assembly shown in FIG. 1.

The various embodiments of a system for opening and closing a lid or door of a receptacle, such as a trashcan, or other device, is disclosed in the context of a trashcan. The present disclosure describes certain embodiments in the context of a trashcan due to particular utility in this context. However, the subject matter of the present disclosure can be used in many other contexts as well, including, for example, commercial trashcans, doors, windows, security gates, and other larger doors or lids, as well as doors or lids for smaller devices such as high precision scales, computer drives, etc. The embodiments and/or components thereof can be implemented in powered or manually operated systems.

It is also noted that the examples may be described as a process, such as by using a flowchart, a flow diagram, a finite state diagram, a structure diagram, or a block diagram. Although these examples may describe the operations as a sequential process, many of the operations can be performed in parallel, or concurrently, and the process can be repeated. In addition, the order of the operations may bedifferent than is shown or described in such descriptions. A process is terminated when its operations are completed. A process may correspond to a method, a function, a procedure, a subroutine, a subprogram, etc. When a process corresponds to a software function, its termination can correspond to a return of the function to the calling function or the main function. Any step of a process can be performed separately or combined with any other step of any other process.

Overview

As shown in FIGS. 1-6, a trashcan assembly 20 can include a body portion 22 and a lid portion 24 pivotably attached to the body portion 22. The trashcan assembly 20 can rest on a floor and can be of varying heights and widths depending on, among other things, consumer need, cost, and ease of manufacture.

The trashcan assembly 20 can receive a bag liner (not shown), which can be retained at least partially within the body portion 22. For example, an upper peripheral edge 26 of the body portion 22 can support an upper portion of the bag liner such that the bag liner is suspended and/or restrained within the body portion 22. In some embodiments, the upper edge 26 of the body portion 22 can be rolled, include an annular lip, or otherwise include features that have a generally rounded cross-section and/or extend outwardly from a generally vertical wall of the body portion 22 (see FIG. 5). The outward-extending, upper peripheral edge 26 can support the bag liner and prevent the bag liner from tearing near an upper portion of the bag liner. Although not shown, in some embodiments, the trashcan assembly 20 can include a liner support member supported by the body portion 22, which can support the bag liner.

FIGS. 1-6 illustrate the body portion 22 having a generally semi-circular configuration with a rear wall 28 and a curved, front wall 30. However, other configurations can also be used, for example, a rectangular configuration. The body portion 22 can be made from plastic, steel, stainless steel, aluminum or any other material.

Figure 11A:
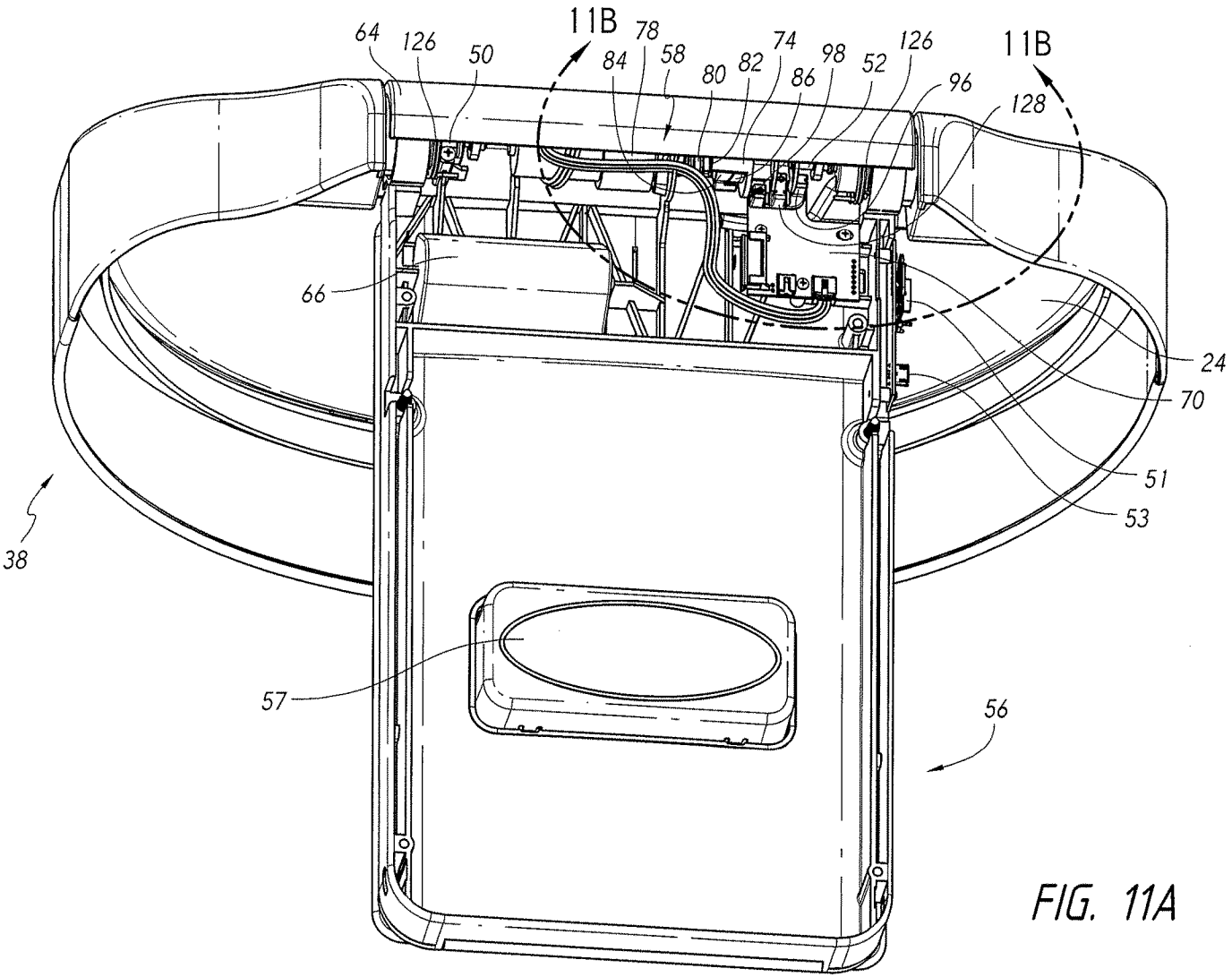
FIG. 11A illustrates an enlarged, rear perspective view of the receptacle assembly shown in FIG. 1 with a rear cover removed.

The pivotal connection between the body portion 22 and the lid portion 24 can be any type of connection allowing for pivotal movement, such as, hinge elements, pins, or rods. For example, as shown in FIG. 11A, the lid portion 24 can pivot about pivot pins 50, 52 extending laterally through a backside enclosure 56. In some embodiments, biasing members 126, such as one or more torsion springs, can be positioned around the pins 50, 52. The biasing members 126 can provide a biasing force to assist in opening and/or closing the lid portion 24. This can reduce the amount of power consumed by a motor 78 when moving the lid portion 24 between the open and closed positions and/or can allow for the use a smaller motor (e.g., in dimensional size and/or in power output).

The trashcan assembly 20 can include a base portion 44. The base portion 44 can have a generally annular and curved skirt upper portion and a generally flat lower portion for resting on a surface, such as a kitchen floor. In some implementations, the base portion 44 can include plastic, metal (e.g., steel, stainless steel, aluminum, etc.) or any other material. In some implementations, the base portion 44 and the body portion 22 can be constructed from different materials. For example, the body portion 22 can be constructed from metal (e.g., stainless steel), and the base portion 44 can be constructed from a plastic material.

Figure 5:
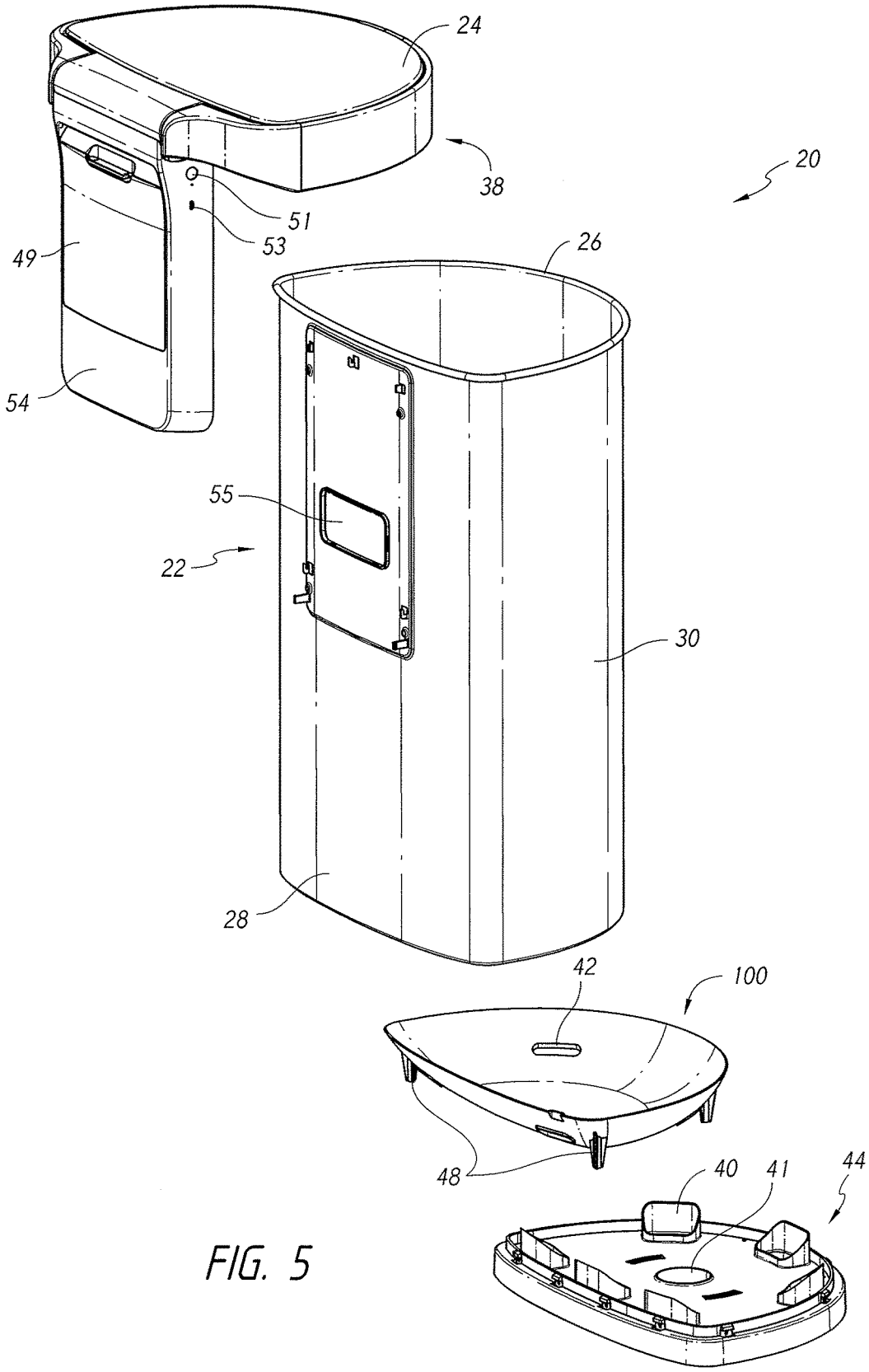
FIG. 5 illustrates a partial-exploded, rear perspective view of the receptacle assembly shown in FIG. 1.
Figure 6:
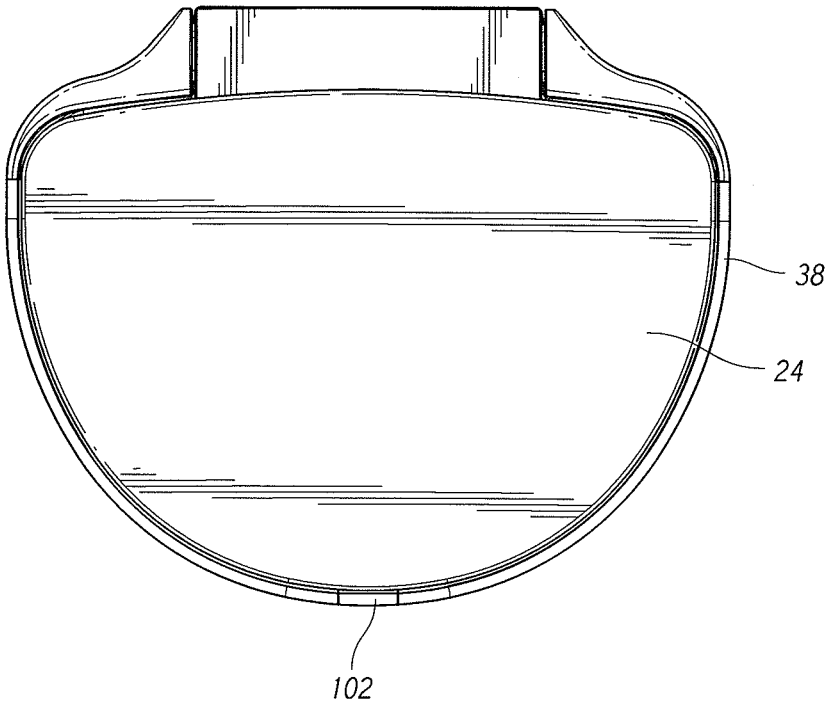
FIG. 6 illustrates a top plan view of the receptacle shown in FIG. 1.

In some embodiments, as shown in FIG. 5, the base portion 44 can be separately formed from the body portion 22. The base portion 44 can be connected with or attached to the body portion 22 using adhesive, welding, and/or connection components 46, such as hooks and/or fasteners (e.g., screws). For example, the base portion 44 can include hooked tabs that can connect with a lower edge (e.g., a rolled edge) of the body portion 22. The hooked tabs can engage the lower edge of the body portion 22 by a snap-fit connection.

As shown in FIG. 5, the base portion 44 can include projections 40 that are open or vented to the ambient environment (e.g., thorough the generally flat lower portion of the base portion 44). As illustrated, certain embodiments of the base portion 44 include a generally centrally located passage 41 extending through the base portion 44.

In some embodiments, the trashcan assembly 20 can include a liner insert 100 positioned within the body portion 22 (see FIG. 5). The liner insert 100 can be secured to the base portion 44. For example, the liner insert 100 can have support members 48 that are joined with the base portion 44 (e.g., with fasteners, welding, etc.). The support members 48 can support and/or elevate the liner insert 100 above away from the base portion 44.

The liner insert 100 can generally support and/or cradle a lower portion of a liner disposed in the trashcan assembly 20 to protect a bag liner from rupture or damage and retain spills. For instance, the liner insert 100 can have a generally smooth surface to reduce the likelihood of the bag liner being torn or punctured by contact with the liner insert 100. As illustrated, the liner insert 100 can be generally concave or bowl-shaped.

The liner insert 100 can reduce the chance of damage to the bag liner even in trashcan assemblies 20 that do not utilize a generally rigid liner that extends along a majority of or all of the height of the body portion 22. In some embodiments, the height of the liner insert 100 can be substantially less than the height of the body portion 22, positioning the uppermost surface of the liner insert 100 substantially closer to the bottom of the trashcan assembly 20 than to the middle and/or top of the trashcan assembly 20. In some embodiments, the height of the liner insert 100 can be less than or generally equal to about one-fourth of the height of the body portion 22. In certain embodiments, the height of the liner insert 100 can be less than or generally equal to about one-eighth of the height of the body portion 22.

The liner insert 100 can form a seal (e.g., generally liquid resistant) with a lower portion of the body portion 22. In some embodiments, the liner insert 100 can include openings 42 that are configured to correspond to, or mate with, the projections 40 located on the interior bottom surface of the base portion 44, thereby placing the openings 42 and the projections 40 in fluid communication. By aligning the openings 42 of the liner insert 100 and the projections 40 of the base portion 44, the openings 42 can allow ambient air to pass into and out of the interior of the trashcan assembly. The openings 42 can inhibit or prevent the occurrence a negative pressure region (e.g., in comparison to ambient) inside the trashcan assembly 20 when a user removes a bag liner from the trashcan assembly 20. Further, in certain variants, when a user inserts refuse or other materials into the bag liner in the trashcan assembly 20, air within the trashcan assembly 20 can exit via the openings 42 and the projections 40. The openings 42 can inhibit the occurrence of a positive pressure region (e.g., in comparison to ambient) inside the trashcan assembly 20 and allowing the bag liner to freely expand.

In some embodiments, the trashcan assembly 20 can include a backside enclosure 56 that can house a plurality of bag liners (not shown). A rear cover 54 can encase an open portion of the backside enclosure 56. The rear cover 54 can include a rear lid 49 that provides access to the interior of the backside enclosure 56, so the user can replenish the plurality of bag liners. An interior surface of the backside enclosure 56 can include an opening 57 that provides access to the plurality of bag liners from the interior of the body portion 22 (see FIG. 11A). The rear wall 28 of the body portion 22 can include an opening 55 in communication with the backside enclosure opening 57. The openings 55, 57 can be positioned such that the user can reach into the interior of the body portion 22 and take a bag liner from the backside enclosure 56. Additional examples and details of bag liner dispensers are included in U.S. Provisional Application No. 61/949,868, filed Mar. 7, 2014, the contents of which are incorporated herein by reference in their entirety. Any structure, feature, material, step, and/or process illustrated or described in such application can be used in addition to or instead of any structure, feature, material, step, and/or process illustrated or described in this specification.

As shown in FIG. 11A, the backside enclosure 56 can house a power source 66 and a power-operated driving mechanism 58 to drive lid movement (discussed in greater detail below). In some embodiments, the backside enclosure 56 can include a port 43 (e.g., a USB port, mini-USB port, or otherwise) for recharging the power source 66 (see FIG. 3). In some embodiments, the backside enclosure 56 can include a power button 51 for turning on and off power to one or more features of the trashcan assembly 20 (see FIG. 3).

A controller 70 (which is stored in the backside enclosure 56 in some embodiments) can control one or more features of the trashcan assembly 20, e.g., the power-operated driving mechanism. The controller 70 can include one or a plurality of circuit boards (PCBs), which can provide hard-wired feedback control circuits, at least one processor and memory devices for storing and performing control routines, or any other type of controller. In some embodiments, the memory included in controller 70 may be a computer-readable media and may store one or more of any of the modules of software and/or hardware that are described and/or illustrated in this specification. The module(s) may store data values defining executable instructions. The one or more processors of controller 70 may be in electrical communication with the memory, and may be configured by executable instructions included in the memory to perform functions, or a portion thereof, of the trashcan assembly 20. For example, in some aspects, the memory may be configured to store instructions and algorithms that cause the processor to send a command to trigger at least one of the several modes of operation (e.g., ready-mode, hyper-mode, calibration-mode, etc.) of the trashcan assembly 20, as described herein in reference to FIGS. 9A-9B and 13.

The backside enclosure 56 can have a generally low profile configuration. For example, the back-side enclosure 56 can extend rearward from the rear wall 28 a distance of less than or equal to about the distance from the rear wall 28 to the furthest rearward extent of the lid portion 24 and/or the furthest rearward extent of a trim ring portion 38, such as less than or equal to about 1 inch, or less than or equal to about ⅕th of the distance between the outside surfaces of the rear wall 28 and the front-most portion of the front wall 30.

Trim Ring Portion

In some embodiments, the trashcan assembly 20 can include a trim ring portion 38 that can secure or retain an upper portion of the bag liner between the trim ring portion 38 and the upper edge 26 of the body portion 22. The trim ring portion 38 can surround at least a portion of the body portion 22 and/or be positioned at least partially above the body portion 22. As illustrated, a diameter of the trim ring portion 38 can be greater than a diameter of the upper portion of the body portion 22, such that the trim ring portion 38 can receive, nest with, and/or or removably lock onto the upper edge 26 of the body portion 22, e.g., by a friction fit. When a bag liner is placed in the body portion 22 and the upper portion of the bag liner is positioned over the rolled edge or annular lip of the upper edge 26, the trim ring portion 38 can be positioned (e.g., rotated into position) such that the bag liner is disposed between the trim ring portion 38 and the body portion 22. The trim ring portion 38 can secure a portion of the bag liner within the body portion 22 and prevent the bag liner from falling into the body portion 22.

The trim ring portion 38 can include a rear-projecting portion 39 that can be secured to the back-side enclosure 56 and/or body portion 22, such as by fasteners 29 (e.g., screws). Some embodiments of the trim ring portion 38 can rotate with respect to the body portion 22 and/or the lid portion 24. The trim ring portion 38 can be made of various materials, such as plastic or metal. The trim ring portion 38 and the body portion 22 can be made from the same or different materials. For example, the trim ring portion 38 and the body portion 22 can be constructed from a plastic material. Some embodiments of the trim ring portion 38 can engage and/or overlap the upper edge 26 of the trashcan assembly 20.

The trim ring portion 38 can be pivotably coupled to the trashcan assembly 20. For example, the lid portion 24 and the trim ring portion 38 can pivot generally along the same pivot axis. In some embodiments, the trim ring portion 38 includes a retaining mechanism to maintain the trim ring portion 38 in an open position while the bag liner is being replaced or the trashcan interior is cleaned. As shown in FIG. 11C, the trim ring portion 38 can include a detent housing 160 positioned within the rear projecting portion 39. The detent housing 160 can be integrally formed with or secured to the outer and/or inner trim ring (if present) 38*a*, 38*b* (see FIGS. 7A and 7B). The detent housing 160 can include a first detent structure 162*a* configured to interface (e.g., engage) with a second detent structure disposed on the backside enclosure 56. As the trim ring portion 38 moves to an open position, the first detent structure 162*a* can interface with the second detent structure 162*b* to maintain the trim ring portion 38 in an open position. In some embodiments, the first detent structure 162*a* can be a tooth, and the second detent structure 162*b* can be a divot, groove, opening, or likewise.

Lid Sensor Assembly

The trashcan assembly 20 can include a sensor assembly 102 for detecting user movement (e.g., by detecting a reflected or emitted signal or characteristic, such as light, thermal, conductivity, magnetism, or otherwise). The sensor assembly 102 can communicate with the controller 70 to control lid movement.

Figure 7A:
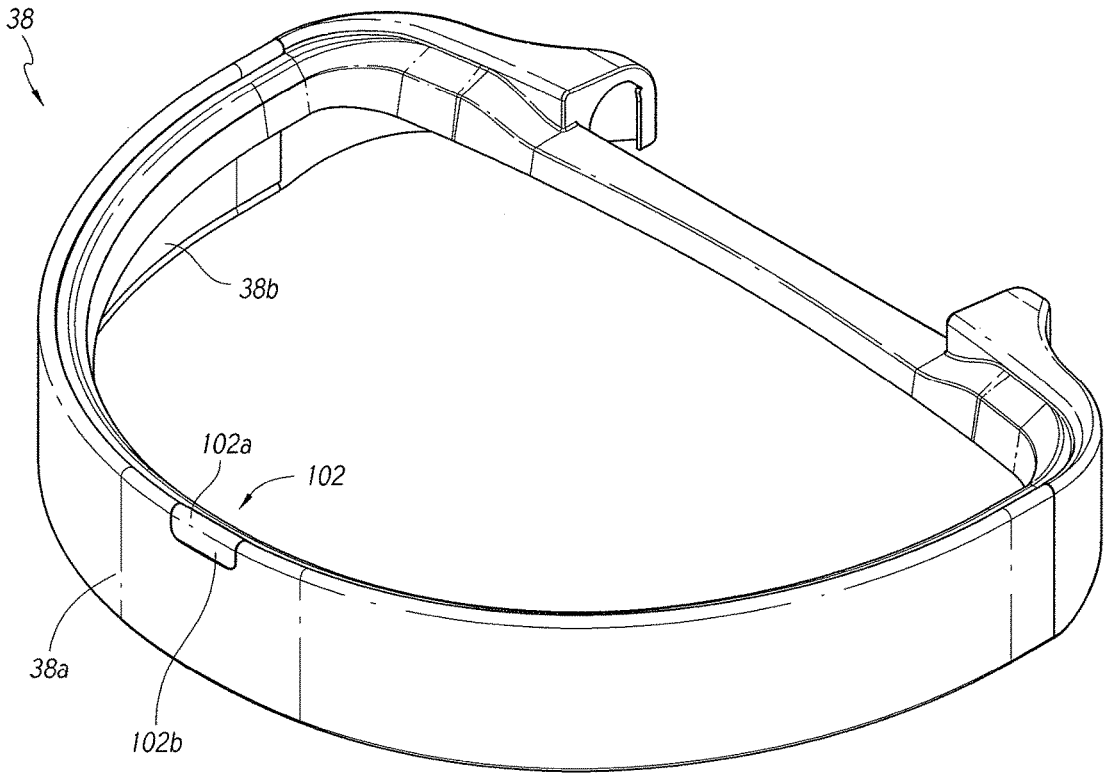
FIG. 7A illustrates a trim ring portion of the receptacle of FIG. 1.
Figure 7B:
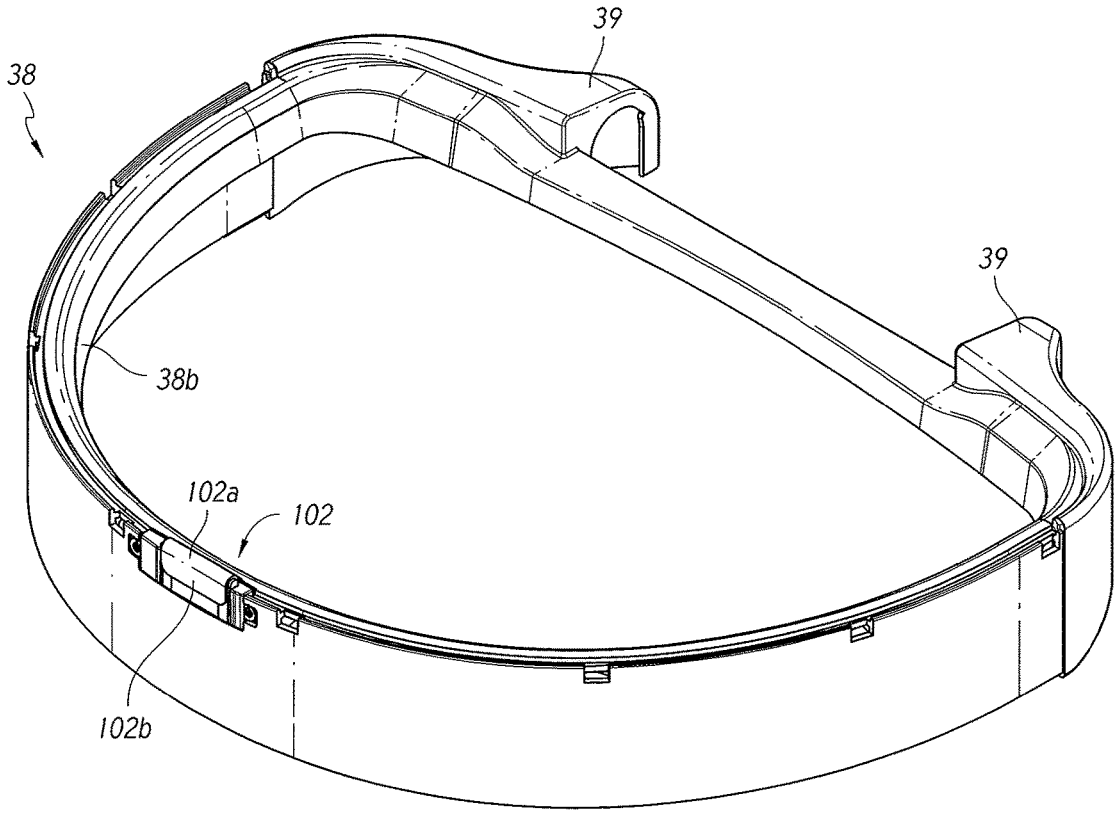
FIG. 7B illustrates the trim ring portion of FIG. 7A with the outer trim cover removed.

The sensor assembly 102 can be disposed on a generally outer portion of the trashcan assembly 20. In some embodiments, the sensor assembly 102 can be positioned at least partially between the outer trim ring 38*a* and the inner trim ring 38*b* (see FIGS. 7A and 7B) with a portion of the sensor assembly 102 exposed to the trashcan exterior. For example, as shown in FIG. 7A, the sensor assembly 102 can be positioned such that at least a portion of an upper surface 102*a* and/or a front surface 102*b* of the sensor assembly 102 is exposed to the trashcan exterior. The sensor assembly 102 can be positioned near a central and/or upper portion of a front surface of the trim ring portion 38, such that the exposed surfaces of the sensor assembly 102 can be substantially flush with, and/or be shaped to generally match or correspond to the shape of, a top surface and/or an outer front surface of the trim ring portion 38.

Figure 8A:
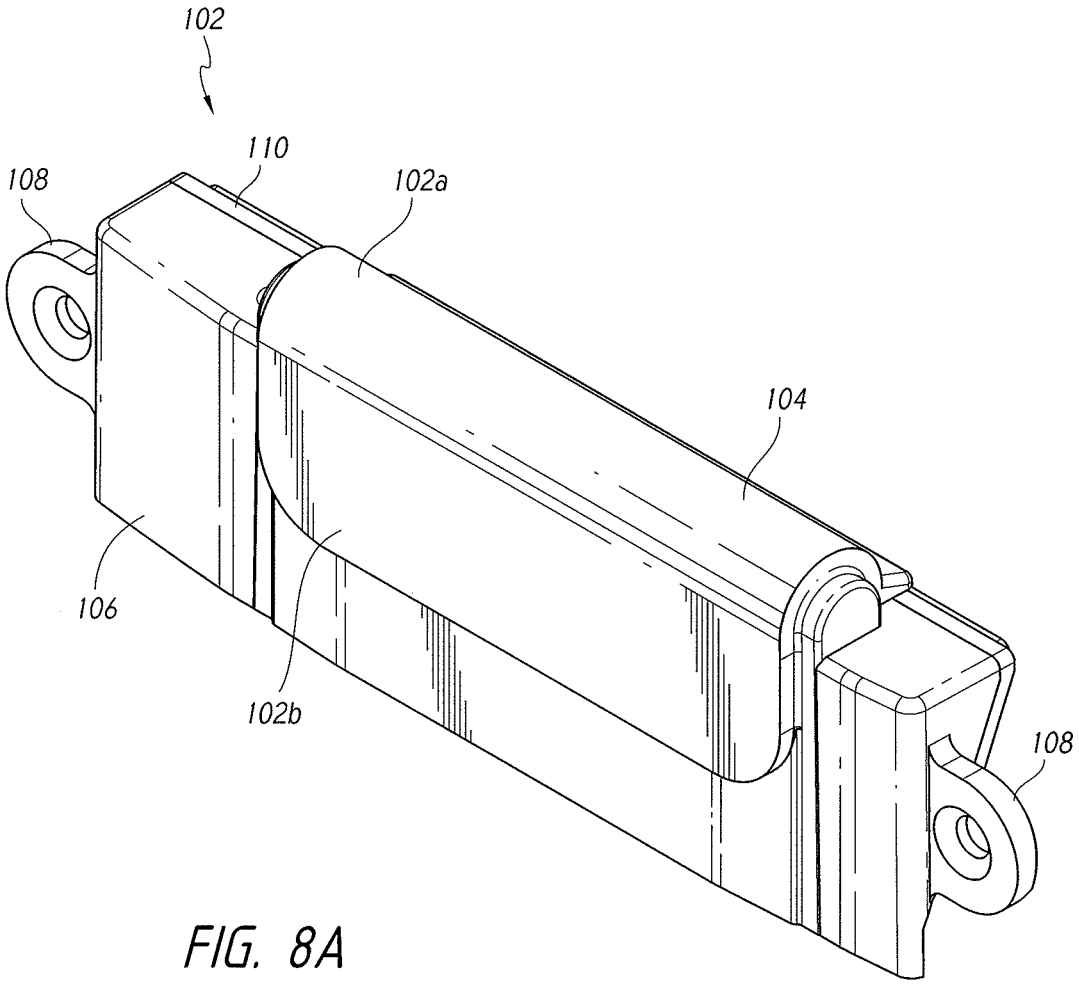
FIG. 8A illustrates a sensor assembly of the receptacle of FIG. 1.
Figure 8B:
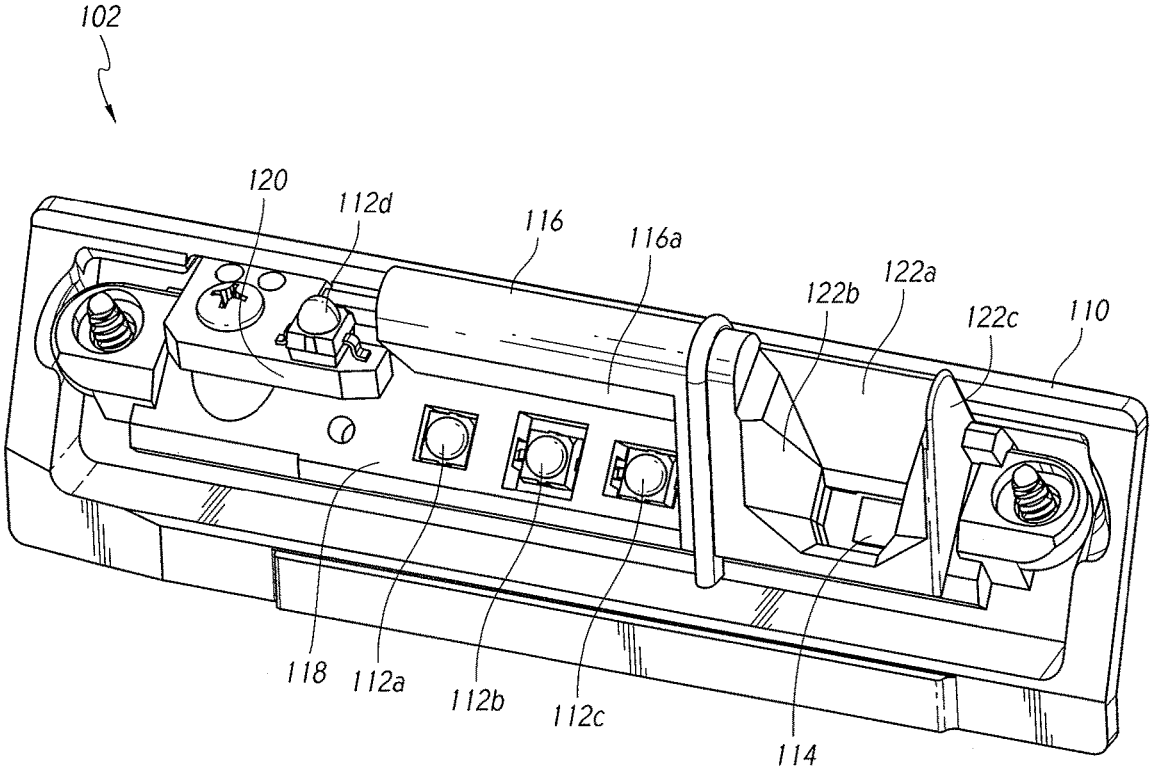
FIG. 8B illustrates the sensor assembly of FIG. 8A with the outer covering removed.

FIGS. 8A and 8B illustrate enlarged views of the sensor assembly 102. The sensor assembly 102 can include a support structure 110 for supporting one or more transmitters and receivers. An outer covering 106 can be secured to the support structure 110 to cover the one or more transmitters and receivers. The outer covering 106 can include one or more connection features 108 for securing the sensor assembly 102 to the trim ring portion 38 (e.g., using screws, hooks, or other fasteners).

The outer covering 106 can include a lens covering 104 that can be transparent or translucent to permit transmission and/or receipt of light signals. For example, the lens covering 104 can be made of glass or plastics, such as polycarbonate, Makrolon®, etc. In some embodiments, the lens covering 104 can be opaque to visible light and transparent or translucent to UV and/or infrared light to reduce erroneous signals from visible light and/or to generally obscure the transmitter(s) and/or receiver(s) from view. The lens covering 104 can be substantially flush with a top surface and an outer front surface of the trim ring portion 38. As shown in FIG. 1, the lens covering 104 of the sensor assembly 102 can be aligned with the trim ring portion 38. The front surface of the lens covering 104 can be aligned with a front surface of the trim ring portion 38, and the top surface of the lens covering 104 can curve over a top edge of the trim ring portion 38 so that the top surface of the lens covering 104 is substantially flush with a rolled edge of the trim ring portion 38. In some embodiments, a width of the lens covering 104 can be at least two times a height of the lens covering 104, e.g., the width can be about 30 mm and the height can be about 7 mm. In some embodiments, the height of the lens covering 104 can be at least about two times a depth of the lens covering, e.g., the height can be about 15 mm and the depth can be about 7 mm.

As shown in FIG. 8B, the sensor assembly 102 can include one or more transmitters 112*a-d* (e.g., one, two, three, four, five or more) and one or more receivers 114 (e.g., one, two, three, four, five or more). The transmitters 112*a-d* can emit electromagnetic energy, such as infrared light. The beams of light emitting from the transmitters 112*a-d* can define one or more overlapping or separate sensing regions 130, 132. In some embodiments, the outer periphery of the sensing regions 130, 132 can be identified by the regions in which an object will not trigger lid movement or where radiant intensity of emitted light falls below 50% of the maximum value. The receiver 114 can receive electromagnetic energy, such as infrared light, and detect reflections from an object within the beams of light emitted from the transmitters 112*a-d*. If the receiver 114 detects a signal above a certain sensing threshold, the sensor assembly 102 can send a signal to the controller 70 to activate a function of the trashcan assembly 20. In certain variants, the transmitters can emit other types of energy, such as sound waves, radio waves, or any other signals. The transmitters and receivers can be integrated into the same sensor or configured as separate components.

The transmitters 112*a-d* can transmit light in more than one direction, e.g., a first subset of transmitters can transmit light in a first direction, and a second subset of transmitters can transmit light in a second direction. As shown in FIG. 8B, the first subset of transmitters 112*a-c* can include a greater number of transmitters than the second subset of transmitters 112*b*. For example, the first subset of transmitters can include three transmitters 112*a-c* and the second subset of transmitters can include a single transmitter 112*d*. However, any number of transmitters can be included in each subset of transmitters and/or additional subsets of transmitters can transmit light in additional directions. In some embodiments, the first subset of transmitters 112*a-c* and the second subset of transmitters 112*d* can be mounted on different PCB boards. However, in other embodiments, all of the transmitters 112*a-b* can be mounted on a single PCB board having a structure to permit the second subset of transmitters 112*d* to be directed at an angle different than the first subset of transmitters 112*a-c*, e.g., in the configuration shown in FIG. 8B.

The first subset of transmitters 112*a-c* can be positioned on or in the support structure 110, such that a transmitting axis of each of one or more of the first subset of transmitters 112*a-c* is generally perpendicular to a front surface 118 of the support structure 110. In some embodiments, the front surface 118 can be positioned at an angle relative to a longitudinal axis of the trashcan assembly 20, such as between about 0 degrees and about 45 degrees (e.g., at least about: 15 degrees, 20 degrees, 25 degrees, 30 degrees, values in between, or otherwise). For example, as shown in FIG. 9C, the first subset of transmitters 112*a-c* can emit light at an angle between about 0 degrees and 60 degrees from a top surface of the trashcan assembly, such as about 45 degrees. The second subset of transmitters 112*d* can be positioned on or in a platform 120 extending from the support structure 110. The platform 120 can be positioned such that a transmitting axis of each of the second subset of transmitters 112*d* is positioned at an angle relative to the front surface 118 of the support structure 110, such as between about 45 degrees and about 90 degrees (e.g., about 45 degrees, 60 degrees, 75 degrees, values in between, or otherwise). In some embodiments, an upper surface of the platform 120 can be generally perpendicular to the longitudinal axis of the trashcan assembly 20. As shown in FIG. 9C, the second subset of transmitters 112*d* are positioned to emit light along an axis substantially parallel to a longitudinal axis of the trashcan assembly 20.

As shown in FIG. 8B, the second subset of transmitters 112*d* and the receiver 114 can be positioned on opposite sides of the first subset of transmitters 112*a-c*. However, in certain variants, the second subset of transmitters 112*d* and the receiver 114 can be positioned on the same side of the first subset of transmitters 112*a-c* or interspersed between transmitters 112*a-c* in the first subset.

The support structure 110 can include a projecting portion 116 extending across at least a portion of a length of the first subset of transmitters 112*a-c*. An inner wall 116*a* of the projecting portion 116 can be generally perpendicular to the front surface 118 of the support structure 110. As shown in FIG. 8B, the projecting portion 116 can extend from an upper portion of the support structure 110 and extend along the length of the first subset of transmitters 112*a-c*. The inner wall 116*a* of the projecting portion 116 can block portions of emissions from the first subset of transmitters 112*a-c* that may accidentally trigger lid movement (e.g., when transmitted light reaches the receiver 114 without first reflecting off a user). In some embodiments, the second subset of transmitters 112*d* can be spaced away from the projecting portion 116, such that the projecting portion 116 does not block emissions from the second subset of transmitters 112*b*.

The receiver 114 can be recessed from the front surface 118 of the support structure. The recessed portion can include an upper wall 122*a* positioned at an angle relative to the longitudinal axis of the trashcan assembly 20, such as between about 0 degrees and about 45 degrees (e.g., at least about: 15 degrees, 20 degrees, 25 degrees, 30 degrees, values in between, or otherwise). The recessed portion can also include sidewalls 122*b*, 122*c*. The sidewall 122*b* can separate the transmitters 122*a-d* from the receiver 114 to reduce the likelihood that emitted light reaches the light receiver without first reflecting off a separate surface (e.g., a user).

The first subset of transmitters 112*a-c* can transmit light in a first direction and the second subset of transmitters 112*d* can transmit light in a second direction. As shown in FIG. 8B, each transmitter in each subset of transmitters can transmit light in substantially the same direction. However, in other embodiments, one or more transmitters in each subset can transmit light in different directions.

Figure 9A:
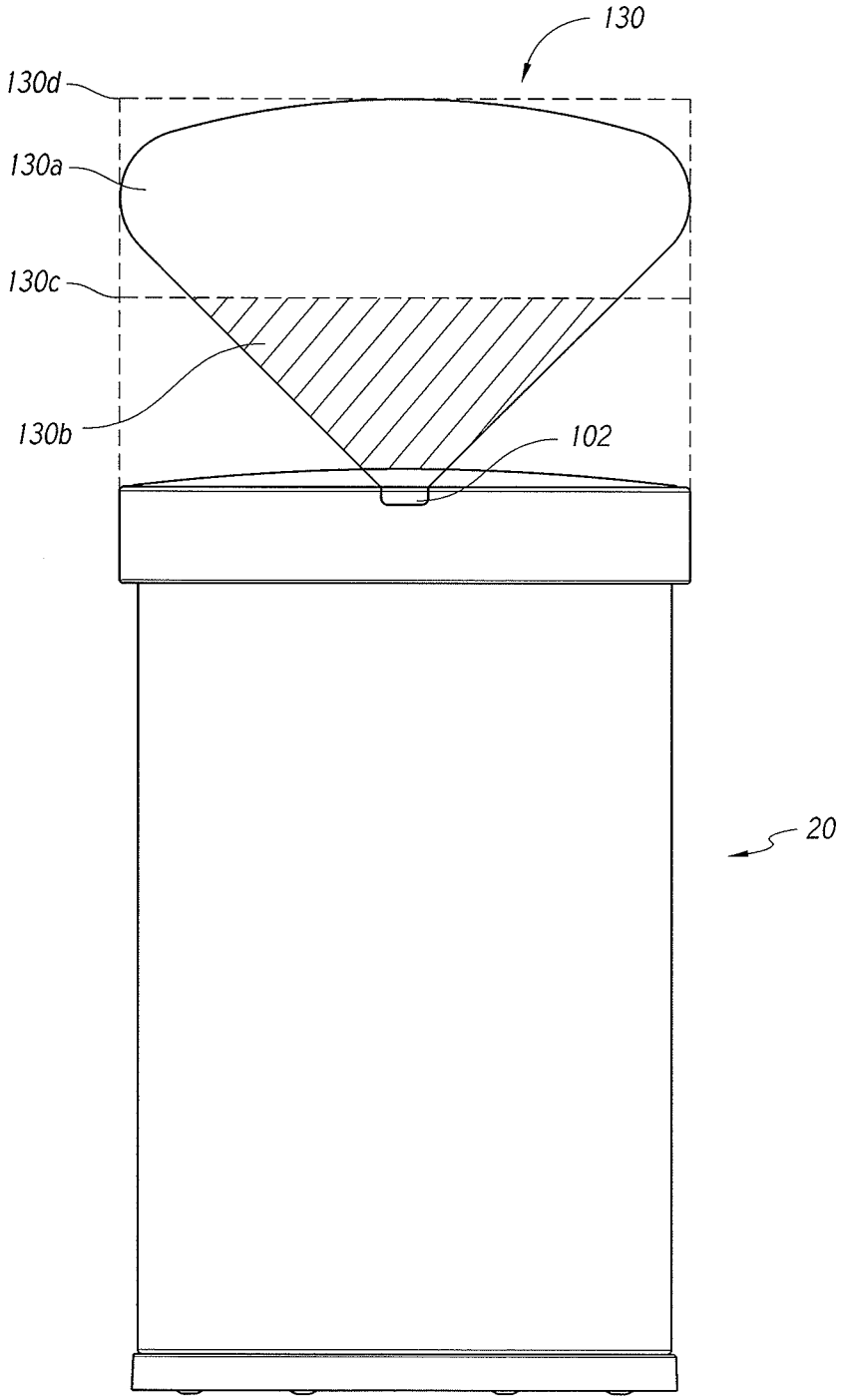
FIG. 9A illustrates an upward sensing range of the receptacle assembly shown in FIG. 1.
Figure 9B:
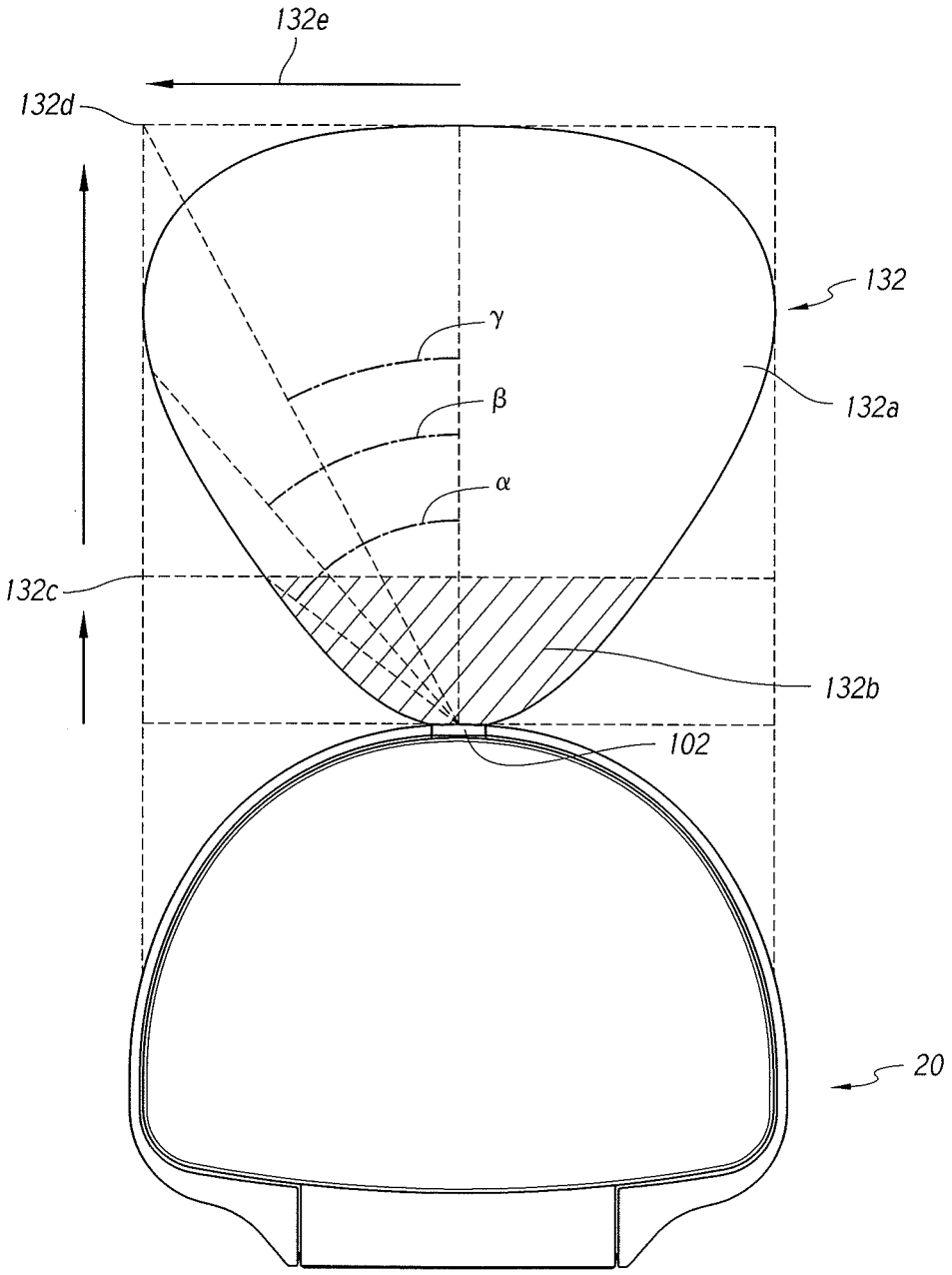
FIG. 9B illustrates an outward sensing range of the receptacle assembly shown in FIG. 1.
Figure 9C:
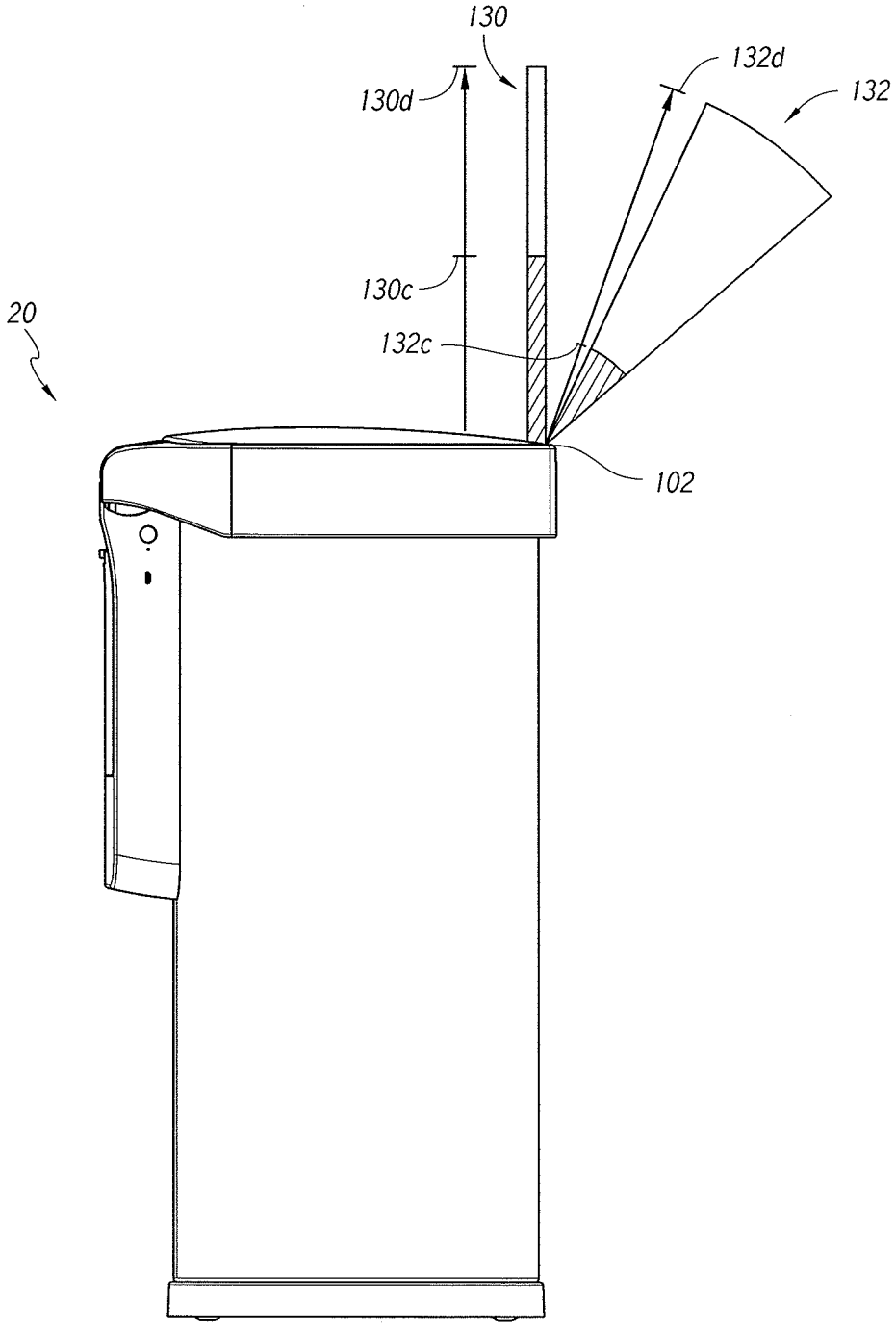
FIG. 9C illustrates a side view of the sensing ranges shown in FIGS. 9A and 9B.

As shown in FIGS. 9A and 9B, the transmitters 112*a-d* can create a first sensing region 130 extending in a first direction and a second sensing region 132 extending in a second direction. In some embodiments, the first direction is between about 30 degrees and about 90 degrees from the second direction, such as between about 30 degrees and about 45 degrees, between about 45 degrees and about 60 degrees, between about 60 degrees and about 75 degrees, or between about 75 degrees and about 90 degrees. The first sensing region 130 can extend generally upward, e.g., within about 15 degrees from the longitudinal axis of the trashcan assembly 20, such that the trashcan assembly 20 can detect user movement above the trashcan assembly 20 (e.g., from a hand waving over the lid portion 24). The second sensing region 132 can extend generally outward from the trashcan assembly 20, e.g., between about 0 degrees and about 60 degrees from a top surface of the trashcan assembly, for example, about 45 degrees, such that the trashcan assembly 20 can detect user movement in front of the trashcan assembly 20 (e.g., from a user standing in front of the trashcan assembly 20).

As explained above, the first subset of transmitters 112*a-c* can include a greater number of transmitters than the second subset of transmitters 112*d*. There can be a greater number of transmitters emitting light in front of the trashcan assembly 20 (e.g., between about 0 degrees and about 60 degrees from a top surface of the trashcan assembly) than transmitters emitting light above the trashcan assembly 20 (e.g., along an axis substantially parallel to a longitudinal axis of the trashcan assembly 20). As shown in FIG. 9C, the first subset of transmitters 112*a-c* can achieve a sensing region 132 having a greater depth (i.e., larger beam angle) than the sensing region 130. In some embodiments, the each of the second subset of transmitters 112*d* can emit a light having a greater half angle than each of the first subset of transmitters 112*a-c*. The half angle being measured from the central transmission axis to a region at which an object can no longer be detected or where radiant intensity falls below 50% of the maximum value. For example, the half angle of transmitter 112*d* can be about 18 degrees and the half angle of each of the transmitters 112*a-c* can be about ten degrees.

In some embodiments, the sensing regions 130, 132 can be adjusted by modifying one or more features of the lens covering 104. For example, the sensing regions 130, 132 can change depending on the angle of the lens cover 104 relative to the axis of light transmission from the transmitters 112*a-d*. As another example, the sensing regions 130, 132 can change depending on the cross-sectional shape of the lens covering 104 (e.g., rectangular or triangular).

In some embodiments, sensor assembly 102 may only require enough power to generate a low power beam of light, which may or may not be visible to the human eye. In some embodiments, the sensor assembly 102 can operate in a pulsating mode. The transmitters 112*a-d* can be powered on and off in a cycle for short bursts lasting for any desired period of time (e.g., less than or equal to about 0.01 second, less than or equal to about 0.1 second, or less than or equal to about 1 second) at any desired frequency (e.g., once per half second, once per second, once per ten seconds). Cycling can greatly reduce the power demand for powering the sensor assembly 102. In operation, cycling does not degrade performance in some embodiments because the user generally remains in the path of the light beam long enough for a detection signal to be generated.

In some embodiments, the trashcan assembly 20 can have one or more modes of operation, for example, a ready-mode and a hyper-mode. In some embodiments, the trashcan assembly 20 can include an algorithm configured to send a command to trigger the trashcan assembly 20 to operate in ready-mode, hyper-mode, or any other mode. For example, the algorithm can send a command to trigger the trashcan assembly 20 to open the lid if an object is detected within the ready-mode sensing regions 130*b*, 132*b*, or the algorithm can send a command to trigger the trashcan assembly 20 to open the lid or keep the lid open if an object is detected or remains for a pre-determined period of time within the hyper-mode sensing regions 130*a*, 132*a*.

In the ready-mode, the lid portion 24 can open when an object is detected within the ready-mode sensing regions 130*b*, 132*b*. As shown in FIGS. 9A and 9B, the upward-directed, ready-mode sensing region 130*b* can extend across a greater distance than the outward-directed (e.g., in front of the trashcan assembly, such as about 45 degrees from a top surface of the trashcan assembly), ready-mode sensing region 132*b*. For example, the ready-mode sensing region 130*b* can extend across a range 130*c*, for example, between about 0 inches and about six inches from an upper surface 102*a* of the sensor assembly 102, and the ready-mode sensing region 132*b* can extend across a range 132*c*, for example, between about 0 inches and about three inches from a front surface 102*b* of the sensor assembly 102. An outer-most portion of the ready-mode sensing region 132 can form a beam angle $\alpha$ between about 30 degrees and about 90 degrees, such as about 60 degrees. The beam angle being measured from the central transmission axis to a region at which an object can no longer be detected or where radiant intensity falls below 50% of the maximum value.

Once the lid portion 24 opens, the lid portion 24 can remain open so long as the sensor assembly 102 detects an object in a sensing region 130, 132. Alternatively, lid portion 24 can remain open for a pre-determined period of time. For example, moving the lid portion 24 can initialize a timer. If the sensor assembly 102 does not detect an object before the timer runs out, then the lid portion 24 returns to a closed position. If the sensor assembly 102 detects an object before the timer runs out, then the controller 70 either reinitializes the timer either immediately or after the timer runs out. In some embodiments, the trashcan assembly 20 can operate in a stay-open mode. If an object or movement of an object is continuously detected in the ready-mode region or hyper-mode region (if activated), then the lid portion 102 can remain open for an extended period of time. This can be useful if a large amount of refuse is being thrown in the trashcan assembly 20 or to clean the interior of the trashcan assembly 20.

Once ready-mode is activated, and/or the lid is open, and/or the sensor detects further movement in the ready-mode regions 130*b*, 132*b*, and/or the sensor detects continued presence of an object in the ready-mode regions 130*b*, 132*b*, for a pre-determined time period, then the sensor assembly 102 can enter a hyper-mode (e.g., during which the sensor assembly 102 has increased sensitivity to movement within a zone, or has a larger or wider sensitivity zone, or has some other increased sensitivity signal detection) for a pre-determined period of time. When the trashcan assembly 20 is in hyper-mode, the lid portion 24 can remain open so long as an object is detected within the ready-mode regions 130*b*, 132*b* or hyper-mode regions 130*a*, 132*a*.

As shown in FIGS. 9A and 9B, the upward-directed, hyper-mode sensing region 130*a* can extend across a range between about 0 inches and about six inches from the ready-mode sensing region 130*b*, e.g., up to about 12 inches from the upper surface 102*a* of the sensor assembly 102. A width of the hyper-mode sensing region 130*a* can extend across at least a majority of or substantially the entire width of the trashcan assembly 20 (i.e., measured from a sidewall to the opposite sidewall of the trashcan assembly 20). For example, the width of the hyper-mode sensing region 130*a* can extend at least about 75% of the width of the trashcan assembly 20 and/or less than or equal to about the width of the trashcan assembly 20. The outward-directed, hyper-mode sensing region 132*a* can extend across a range 132*d*, for example, between about 0 inches and about nine inches from the ready-mode sensing region 132*b*, e.g., up to about 12 inches from the front surface 102*b* of the sensor assembly 102. A width 132*e* of the hyper-mode sensing region 132*a* can extend across at least a majority of or substantially the entire width of the trashcan assembly 20. For example, the width of the hyper-mode sensing region 132*a* can be at least about 75% of the width of the trashcan assembly 20 and/or less than or equal to about the width of the trashcan assembly 20. For example, width 132*e* can be between approximately 0 and approximately 7 inches. In some embodiments, the range 130*d* of the upward-directed hyper-mode region 130*a* can be about the same as the range 132*d* of the outward-directed, hyper-mode region 132*a*. In some embodiments, the angle of the sensing region 132 can decrease across the hyper-mode sensing region 132*a*. For example, an inner portion of the hyper-mode sensing region 132*a* can form a beam angle $\alpha$ between about 30 degrees and about 90 degrees, such as about 60 degrees. A mid-portion of the hyper-mode sensing region 132*a* can form a beam angle $\beta$ between about 15 degrees and about 75 degrees, such as about 47 degrees. An outer-portion of the hyper-mode sensing region 132*a* can form a beam angle $\gamma$ between about 0 degrees and about 60 degrees, such as about 30 degrees.

In some embodiments, these arrangements of transmitter(s) and/or receiver(s), or one or more other arrangements of transmitter(s) and/or receiver(s), in cooperation with one or more processing algorithms in the controller, can be configured to trigger an opening of the lid, in either the ready-mode or the hyper-mode, that occurs in one or more of the following situations: (a) when an object is positioned at or near a front, top, lateral corner or region (left or right) of the trashcan assembly; (b) when an object is positioned in front of the front plane or front portion of the trashcan assembly and spaced further laterally away from a lateral side (either left or right) or lateral face of the trashcan; (c) when an object is positioned at or below the top plane of the lid in the closed position, such as below the top plane of the lid in the closed position by at least about the front height of the trim ring, and/or below the plane of the lid in the closed position by at least about 2 inches, and/or below the plane of the lid in the closed position by at least about the front-to-rear thickness of the trim ring; (d) when an object is positioned above the topmost surface of the trashcan; (e) when an object is positioned above the topmost surface of the trashcan and in front of the frontmost surface of the trashcan; and/or (f) when an object is positioned above the topmost surface of the trashcan and behind the frontmost surface of the trashcan. In some embodiments, the sensing regions 130, 132 may have varying levels of sensitivity. The transmitters 112*a-d* can emit cones of light, which define the sensing regions 130, 132 of the sensors (subject to the nominal range of the sensor assembly 102). The areas in which two or more cones overlap can create sensing regions with increased sensitivity. Portions of the sensing regions 130, 132 in which cones do not overlap create regions of decreased sensitivity. A user may need to be present in the regions with decreased sensitivity for a longer period of time, or move closer to a transmitter or receiver, to trigger lid movement as compared to regions with increased sensitivity.

In some embodiments, the controller 70 can trigger an extended-chore mode in which the trim ring portion 38 can open (as described above) to permit the user to replace the bag liner or clean the interior of the trashcan assembly 20. For example, the trashcan assembly 20 can include a separate sensor assembly or sensing region (e.g., on a lateral sidewall of the body portion 22 or the rear wall 28 of the body portion) configured to trigger the extended-chore mode. As another example, the user can trigger the extended-chore mode by particular hand motions. In some embodiments, the user can manually position the trim ring portion 38 in an open mode.

In some embodiments, the controller 70 can trigger a calibration-mode in which sensing thresholds of receiver 114 may be adjusted to account for changes in environment surrounding the trashcan assembly 20. The calibration-mode can be configured to avoid unintended actuation (e.g., opening) of the trashcan lid by stationary objects located within one or more sensing zones 130*b*, 132*b*. For example, receiver 114 of sensor assembly 102 may detect an object within sensing regions 130*b*, 132*b* by detecting one or more signals from one or more of transmitters 112*a-d* that are reflected off from the object. Having detected an object in one or more of the sensing regions 130*b*, 132*b*, the sensor assembly 102 can send a signal to controller 70 to activate a function of the trashcan assembly 20, e.g., ready-mode. However, situations may occur where a permanently or temporarily stationary or static object is located within one or more of sensing regions 130*b*, 132*b* of trashcan assembly 20, such as when the user places the trashcan assembly 20 near a stationary object, thereby positioning the object within sensing regions 130*b*, 132*b*. Some examples of stationary objections that may routinely be placed within a sensing region 130*b*, 132*b* include a wall, or a piece of furniture, or the underside of a table or desk, or an interior of a cabinet, or a door. For example, the trashcan assembly 20 may be placed under a table located within at least one of the sensing regions 130*b*, 132*b*. This may result in unintended or accidental operation of lid portion 24 due to the table being positioned within sensing regions 130*b*, 132*b*, because receiver 114 may detect a signal, reflected from the table, above the sensing threshold, causing sensor 102 to send a signal to controller 70 to activate the ready-mode. In another example, degradation of receiver 114 over time may result in sensor drift, which may cause unintended actuation of lid portion 24. In some embodiments, an algorithm included in controller 70 can send a command to adapt the sensing thresholds of receiver 114 based at least in part on changes in the surrounding environment located within the sensing regions 130*b*, 132*b*.

Figure 13:
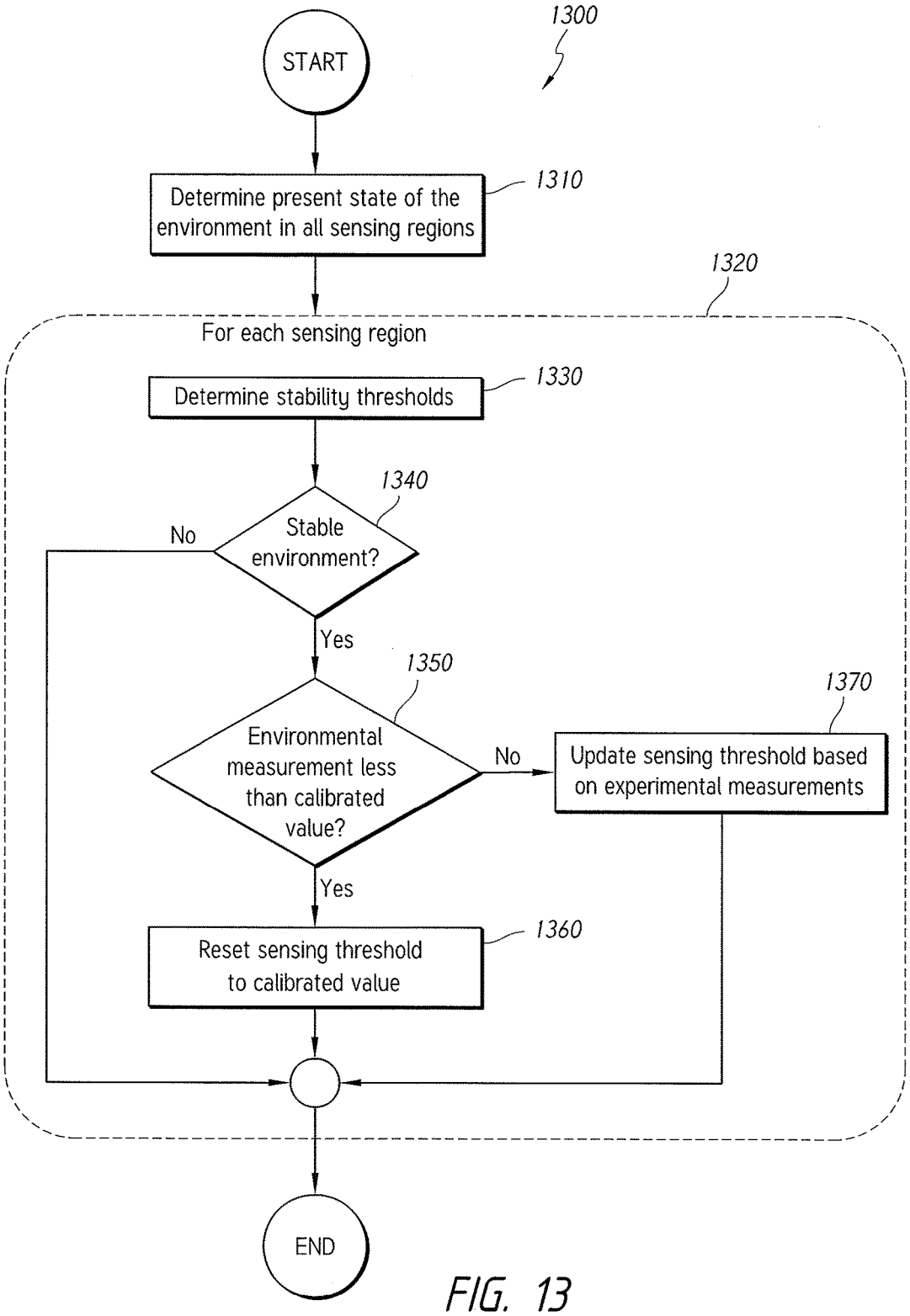
FIG. 13 is an example of a flowchart of a method for adapting sensing thresholds of the receptacle assembly shown in FIG. 1.

An exemplary method of adapting sensing conditions of trashcan assembly 20, in accordance with some embodiments, will now be described in reference to FIG. 13. In some embodiments, the adaptable sensing condition is a sensing threshold of receiver 114 that is adaptable based, at least in part, on a change in the environment positioned within the sensing regions 130, 132. Process 1300 may be performed by controller 70 of trashcan assembly 20, as described in reference to FIG. 11A. The method can be implemented, in part or entirely, by a software module of the controller 70 or implemented elsewhere in the trashcan assembly 20, for example by one or more processors executing logic in controller 70. In some embodiments, controller 70 includes one or more processors in electronic communication with at least one computer-readable memory storing instructions to be executed by the at least one processor of controller 70.

In some embodiments, process 1300 starts at a start block where a calibration-mode can be initiated. In some embodiments, process 1300 may be initiated by an algorithm of controller 70 that is configured to periodically scan the surrounding environment. This scan can occur with or without user initiation or interaction. For example, in automatic calibration, at a set time interval (e.g., once an hour, once a day, once a week, etc.) controller 70 may send a command to trigger calibration-mode. The automatic periodic scan permits the trashcan assembly 20 to continuously and automatically monitor the surrounding environment and update sensing thresholds in accordance with the method described in reference to FIG. 13. In some embodiments, the controller 70 can include an algorithm configured to send a command triggering calibration-mode based on user input. For example, trashcan assembly 20 may include a button (not shown) that a user may operate to manually activate a calibration-mode, such as when the trashcan is positioned in a new location near stationary objects. In some embodiments, a user may place a stationary object within sensing regions 130*b*, 132*b* (e.g., by moving a piece of furniture near the trashcan assembly 20 or by moving the trashcan assembly 20 near a piece of furniture) and the detection of the object within the sensing regions 130*b*, 132*b* may trigger a calibration-mode prior to activating ready-mode. For example, if the trashcan assembly 20 is actuated by an object within a sensing region 130*b*, 132*b* that does not move for longer than a set period of time (e.g., 5 minutes, 10 minutes, 30 minutes, an hour, etc.), then a calibration-mode may be triggered. In some embodiments, controller 70 may automatically send a command to trigger a calibration-mode when a user manually moves the lid (e.g., to open or close it). For example, if the lid is improperly opening or remaining open because a stationary object is within one or more sensing regions 130*b*, 132*b*, a user may manually close the lid, which may automatically trigger a calibration-mode. Also, if a user manually opens the lid portion 24, this may be indicative that one or more current sensing thresholds are inaccurate and that the controller 70 is missing events that should cause trashcan assembly 20 to actuate.

After calibration-mode is initiated, the process 1300 continues to block 1310, where a present state of the environment surrounding trashcan 20 is determined. For example, present proximity measurements are acquired for one or more or all sensing regions of trashcan assembly 20. In some embodiments, one or more proximity measurements may represent the distance between the trashcan assembly 20 and objects located in the environment surrounding the trashcan assembly 20. In some embodiments, acquiring proximity measurements for sensing regions includes detecting one or more objects located within sensing regions 130, 132. For example, the transmitters 112*a-d* may emit a signal into sensing regions 130, 132 and objects located within sensing regions 130, 132 may cause a reflected signal. The reflected signal, detected by receiver 114, may cause the sensor assembly 102 to send an electronic signal to the controller 70 to store information about nearby objects in the sensing regions 130*b*. 132*b* in the memory of controller 70. It will be understood that, while the embodiments disclosed herein refer to sensing regions 130 and 132, the method of FIG. 13 may not be limited to one or two sensing regions, but may include any number of sensing regions or directions. After determining the present state of the environment, the process continues to subprocess 1320 for each sensing region of the trashcan assembly 20.

For a plurality of sensing regions, subprocess 1320 can continue to block 1330, where stability thresholds are determined. In some embodiments, the stability thresholds may be based, at least in part, on past proximity or environmental measurements of a given sensing region. A set of past proximity measurements may be stored in the memory of controller 70. The controller 70 may be configured based on instructions to compute the stability thresholds based on the set of past proximity measurements. For example, the stability threshold may include an average of past proximity measurements. In some embodiments, the stability threshold may be based on all past measurements, or the average may be based on a set of past measurements corresponding to a predetermined time period (e.g., past proximity measurements of the previous day or week or month). In some embodiments, the stability threshold may include a determination of the variability within the past proximity measurements of a given sensing region. For example, the stability threshold may be based on the standard deviation of past proximity measurements used to determine the average proximity measurement.

After the stability thresholds are determined, the process 1300 continues to decision block 1340, where a determination is made as to whether the environment is stable within a given sensing region. In some embodiments, the environment may be deemed stable based, at least in part, on a comparison of the stability thresholds and the current proximity measurement for a given sensing region. For example, if the current proximity measurement acquired in block 1310 for a given sensing region is outside, e.g., exceeds or is below, the stability threshold determined in block 1330, then the environment is not determined to be stable (e.g., "not stable"). In some embodiments, where the current proximity measurement from block 1310 is off of the average proximity measurement and outside of the standard deviation, then the environment may be deemed not stable. In some embodiments, if decision block 1340 determines that the environment is not stable, then the process 1300 continues to an end block, the sensing threshold is not updated, and the process 1300 is complete. In some embodiments, the determination that the environment is not stable may trigger one or more other functions of trashcan assembly 20, e.g., ready-mode, hyper-mode, etc., as detailed herein.

If decision block 1340 determines that the environment is stable, based, at least in part, on the comparison of the stability thresholds and present state of the environment, then process 1300 continues to decision block 1350. At decision block 1350 a determination is made as to whether the environmental measurement (e.g., the distance between a sensor and a stationary object) of a given sensing region is less than a calibrated value for that sensing region. In some embodiments, the calibrated value may be the sensing threshold of receiver 114 preinstalled in the controller 70 that causes sensor assembly 102 to send a signal to controller 70 to activate a function of the trashcan assembly 20. The calibrated value may be based on an expected detection of reflected light of an object in sensing regions 130*b*, 132*b* that activates ready-mode operation. The calibrated value may be locally stored in the memory of controller 70. In some embodiments, the predetermined calibrated value may include sensing thresholds previously updated due to a prior iteration of process 1300. In some embodiments, the stability of the environment may be determined based at least in part on the present state of the environment for a given sensing region determined in block 1310. In some embodiments, the stability of the environment may be determined based at least in part on the average of past proximity measurements determined in block 1330. In some embodiments, the controller 70 may include an algorithm configured to send a command to compare the proximity measurement with the calibrated value.

If a determination is made that the environmental measurement is less than the predetermined calibrated value, then process 1300 continues to block 1360. At block 1360, the sensing threshold for a given sensing region is reset to the calibrated value. For example, the sensing thresholds may be adjusted to the preinstalled sensing threshold based on the calibrated value, thereby prohibiting receiver 114 from detecting objects outside of the given sensing regions, for example, due to sensor drift. In some embodiments, the updated sensing threshold may be stored in the memory of controller 70.

If the determination at decision block 1350 is that an environmental measurement is greater than the calibrated value, then process 1300 continues to block 1370. At block 1370, the sensing threshold for a given sensing region is normalized based on the environmental measurement. The updated sensing threshold may be stored in the memory of controller 70. In some embodiments, the environmental measurement may be based on the present state of the environment, as determined in block 1310. In some embodiments, the environmental measurement may be based on the average of past proximity measurements, as determined in block 1330. In embodiments where the environmental measurement is greater than the calibrated value, the environmental measurement may represent a static change in the environment located within in the given sensing region. The controller 70 may include an algorithm to issue a command to normalize or calibrate the sensing thresholds, such as in process 1300, to accommodate the static change. For example, the sensing thresholds may be adjusted or normalized. For example, a reflected signal received by receiver 114 from a static change may produce an adjustment or normalization that represents a triggering measurement beyond which the ready-mode operation will be activated. In some embodiments, unintended or accidental movement of lid portion 24 may be avoided by normalizing the sensing thresholds based on the static change.

In some embodiments, the sensing threshold may be updated to be equal to the environmental measurement plus a margin. Thus, the sensing thresholds may be set marginally beyond the environmental measurement, for example, based on the standard deviation determined in block 1330. By setting the sensing threshold marginally beyond the environmental measurement, the controller 70 may account for noise detected by sensor assembly 102 or other inconsequential variations in the detected surroundings. Sensing thresholds can be adapted or normalized to accommodate static changes in the surrounding environment, e.g., a new piece of furniture placed near trashcan assembly 20. In some embodiments, a fixed object or static object within sensing regions 130*b*, 132*b* may not trigger ready-mode, or may avoid a repeated triggering or ready-mode, thereby avoiding repeated unintended or accidental opening of the lid portion 24.

Once the sensing thresholds are updated for one or more sensing regions, either from block 1360 or 1370, the process 1300 continues to an end block and the process 1300 is completed. Upon completion of process 1300, the process 1300, or portions thereof, may be repeated. In some embodiments, the controller 70 may continuously or periodically monitor the surrounding environment and update the sensing thresholds as needed. In some embodiments, controller 70 may send a command to trigger calibration-mode based on a predetermined time interval, e.g., once an hour, a day, a week, or a month, etc. In some embodiments, controller 70 may monitor the surrounding environment to update sensing thresholds as necessary without constantly operating sensor assembly 102. In some embodiments, periodic rather than continuous running of calibration-mode, including sensor assembly 102, can reduce the power demand for powering the sensor assembly 102, thereby improving the performance and life of sensor assembly 102. In some embodiments, controller 70 may not trigger process 1300 until receiving a user input, e.g., user operating a button or selecting a command prompt.

Lid Driving Mechanism

As mentioned above, the backside enclosure 56 can house a power source 66 and a power-operated driving mechanism 58 to drive lid movement. The driving mechanism 58 can include a drive motor 78 and a shaft 80. In some embodiments, the driving mechanism 58 can include a clutch member 84 that can translate along at least a portion of the longitudinal length of the shaft 80. The clutch member 84 can be positioned on the motor shaft 80 between a biasing member 82 (e.g., a spring) and an end member 86 (e.g., a torque transmission member) (see FIG. 12), such that the biasing member 82, the clutch member 84, and the end member 86 are generally coaxial. At least some of the driving mechanism components can be removably coupled to facilitate repair, replacement, etc.

Figure 12:
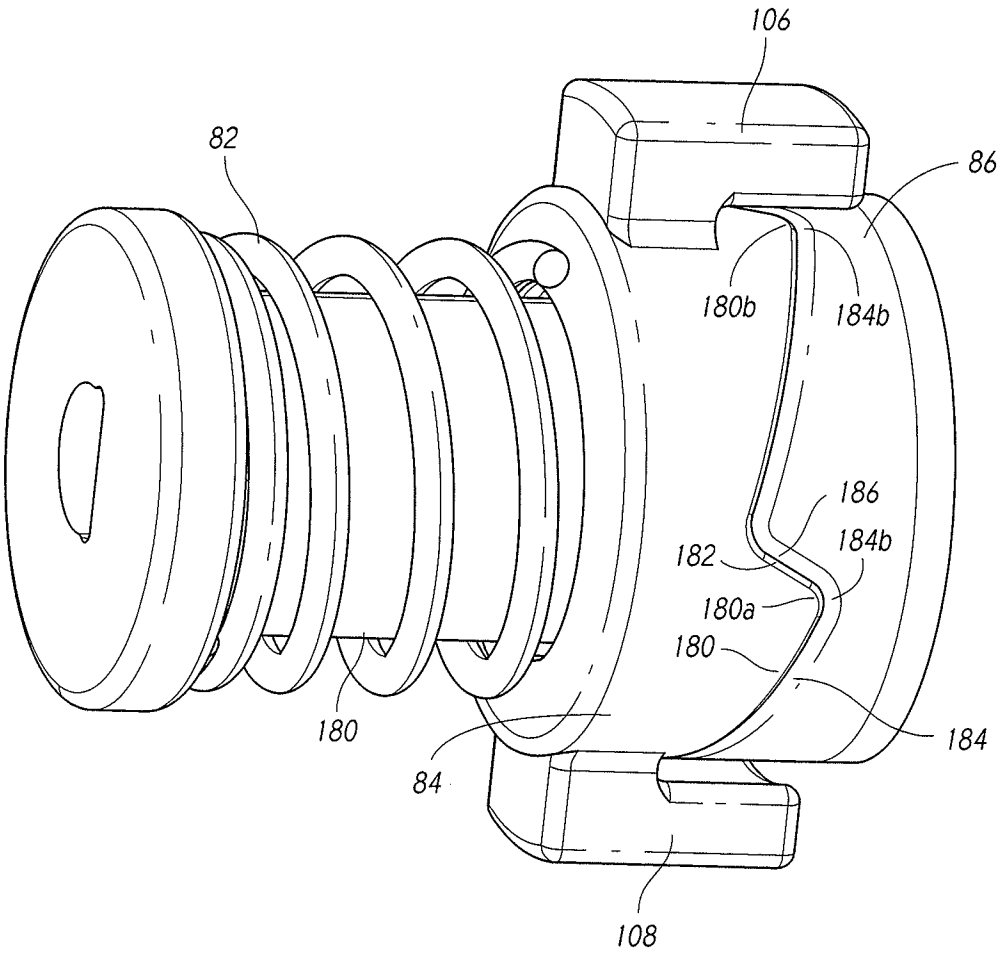
FIG. 12 illustrates an enlarged perspective view of a portion of a drive mechanism.

As shown in FIG. 12, the clutch member 84 can include one or more torque transmission members, such a first arm 106 and a second arm 108 that can extend radially outward from a body of the clutch member 84. In some embodiments, the arms 106, 108 can be spaced apart from each other, such as by about 180 degrees. Various other angles are contemplated, such as at least about: 30°, 45°, 60°, 90°, 120°, values in between, or otherwise.

In some embodiments, the end member 86 can be fixed to the motor shaft 80 (e.g., by a fastener), such that torque from the motor 78 can be transmitted through the shaft 80 and into the end member 86. The biasing member 82 can bias the clutch member 84 against the end member 86 to form a frictional interface between the clutch 84 and end member 86. The frictional interface causes the clutch member 84 to rotate when the end member 86 rotates.

As shown in FIG. 11A, the lid portion 24 can include a rear portion 64 covering at least a portion of the driving mechanism 58. The lid portion 24 can include a lid driving portion 74 positioned at or near the rear underside of the lid portion 24. The lid-driving portion 74 can abut, mate, contact, receive, and/or be received by the drive mechanism 58 to facilitate opening and closing the lid portion 24. For example, the lid-driving portion 74 can be generally arcuately-shaped and surround at least a portion of the drive mechanism 58. The lid-driving portion 74 can include rotation support members, such as a first flange 88 and a second flange 90 that can extend radially inward. The flanges 88, 90 can interface with the clutch member 84, such that rotation of the clutch member 84 can drive lid movement. Rotational force produced by the motor 78 (via the shaft 80, end member 86, and/or clutch member 84) encourages rotation of the arms 106, 108 against the flanges 88, 90 to rotate the lid portion 24.

In some scenarios, a user may accidentally or intentionally try to manually close or open the lid portion 24. However, manually closing the lid portion 24 when the motor has opened or is in the process of opening the lid portion 24 acts against the operation of the motor 78 and can damage components of driving mechanism 58. For example, when the motor 78 is opening the lid portion 24, the motor 78 encourages the arms 106, 108 to abut against and turn the flanges 88, 90 in a first direction. Yet, when a user manually attempts to close the lid portion 24, the lid and the flanges 88, 90 are encouraged to rotate in a second direction opposite the first direction. In this scenario, the arms 106, 108 are being encouraged to rotate in opposite directions concurrently, which can damage the clutch member 84, the shaft 80, and the motor 78.

To avoid such damage, the clutch member 84 can be configured to rotate relative to the end member 86 or other components, such that manual operation of the lid portion 24 does not damage (e.g., strip or wear down) components of the driving mechanism 58. In some embodiments, the clutch member 84 can include a first cam surface 180 and a first return surface 182 (see FIG. 12). The first cam surface 180 can be inclined from a first level to a second level, in relation to a plane extending generally transverse to the longitudinal axis of the clutch member 84. The first return surface 182 can intersect the first cam surface 180 and can be disposed between the first and second levels.

The end member 86 can include a second cam surface 184 and a second return surface 186. The second cam surface 184 can be inclined from a first level to a second level, in relation to a plane extending generally transverse to the longitudinal axis of the end member 86 and the shaft 80. The second return surface 186 can intersect the first cam surface 180 and can be disposed between the first and second levels.

The second cam surface 184 and the second return surface 186 of the end member 86 can be shaped to correspond with the first cam surface 180 and the first return surface 182 of the clutch member 84, thereby allowing mating engagement of the end member 86 and the clutch member 84. For example, summits 180*a* of the first cam surface 180 can be nested in the valleys 184*b* of the second cam surface 184, and summits 184*a* of the second cam surface 184 can be nested in the valleys 180*b* of the first cam surface 180.

When the lid portion 24 is manually operated, the first inclined cam surface 180 can move relative to the second inclined cam surface 184. As the inclined cam surface 180 slides relative to the second inclined cam surface 184, the summit 180*a* circumferentially approaches the summit 184*a*. The relative movement between the first and second inclined cam surfaces 180, 184 (e.g., by the interaction of the inclines) urges the clutch member 84 away from the end member 86 along the longitudinal axis of the shaft 80 (e.g., in a direction generally toward the motor 78 and against the bias of the biasing member 82). The end member 86 can be generally restrained from moving longitudinally (e.g., by the fastener). Since the clutch member 84 is displaced from the end member 86, manual operation of the lid portion 24 can be performed without imposing undue stress on, or damage to, components of the trashcan assembly 20

When manual operation of the lid portion 24 ceases, the biasing member 82 can return the clutch member 84 into generally full engagement with the end member 86. Re-engaging the clutch member 84 and the end member 86 permits transmission of torque from the motor 78 to the clutch member 84 to drive lid movement.

Figure 11B:
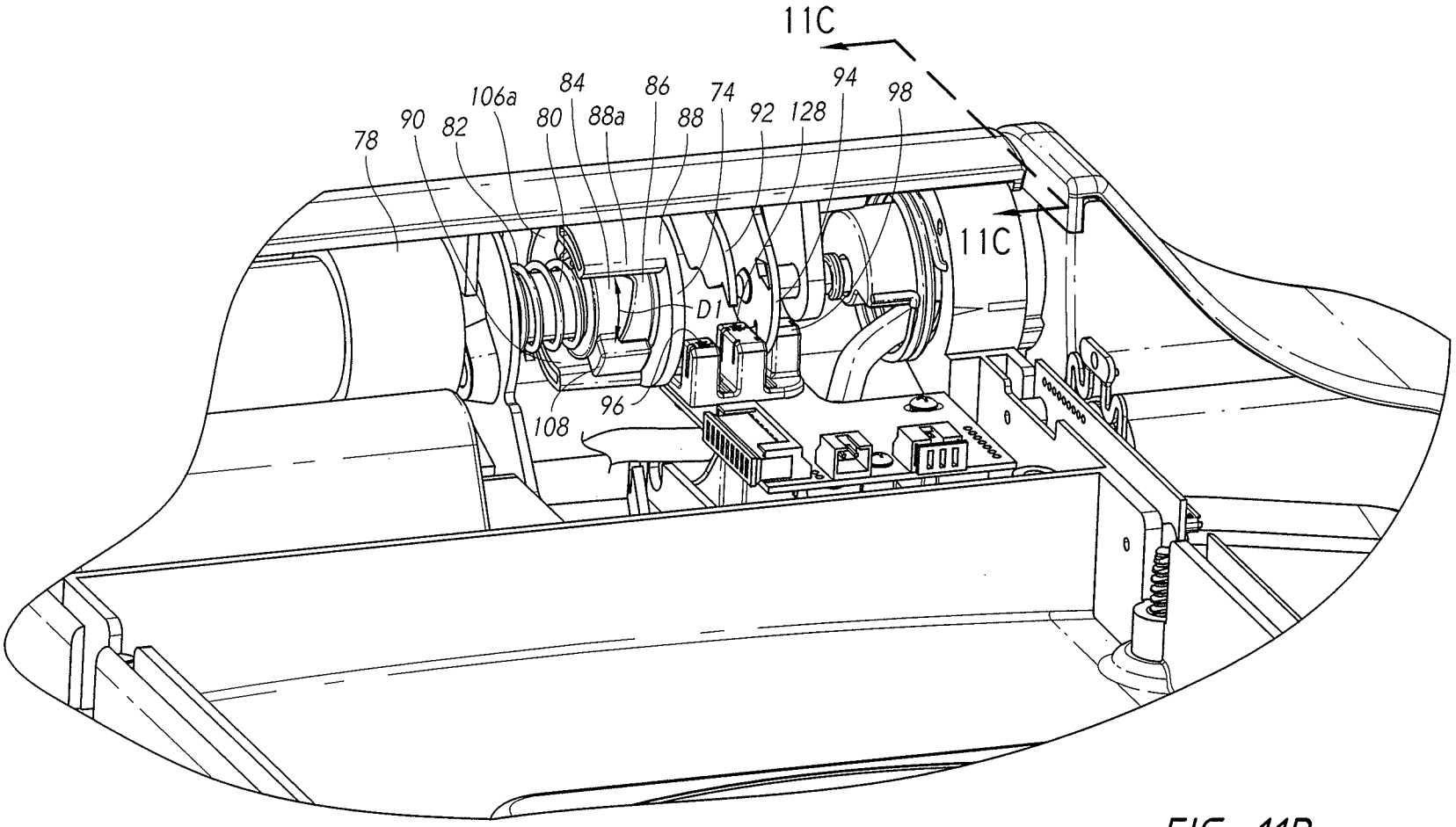
FIG. 11B illustrates an enlarged view of the driving mechanism shown in FIG. 11A, taken along line 11B-11B.
Figure 11C:
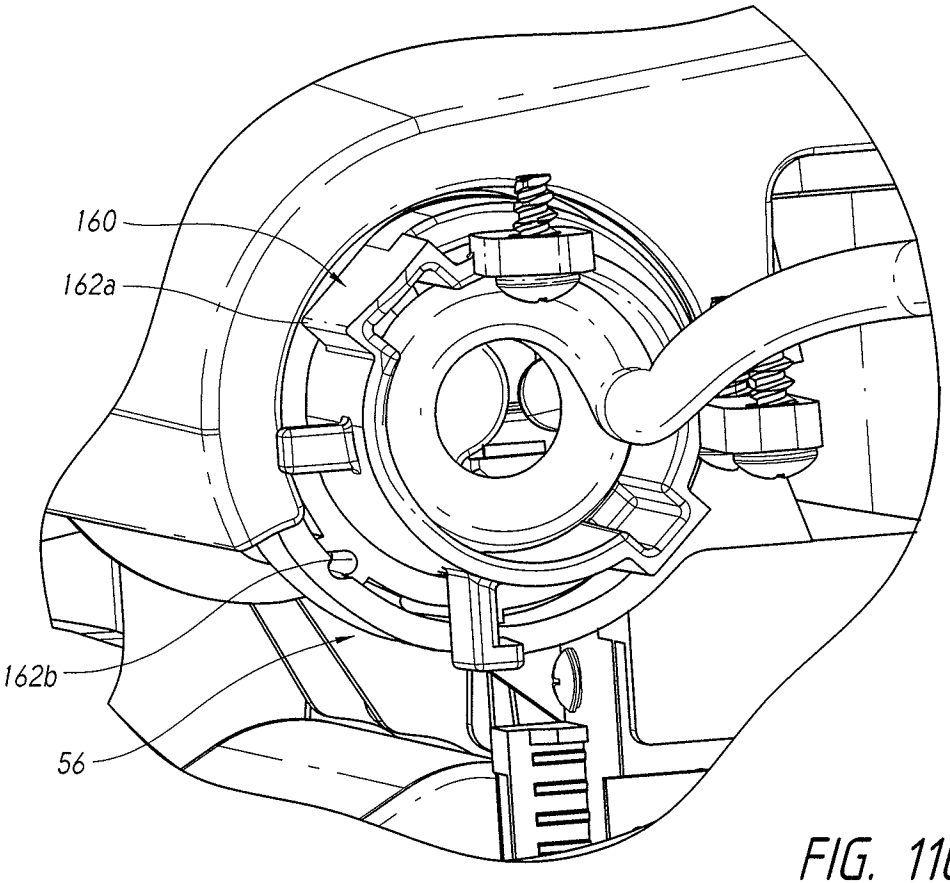
FIG. 11C illustrates an enlarged, cross-sectional view of the trim ring portion shown in FIG. 11B taken along line 11C-11C.

As shown in FIG. 11B, when the first arm 106 abuts the first flange 88 and the second min 108 abuts the second flange 90, a circumferential distance D1 exists between a non-abutted surface 108*a* of the second arm 108 and a non-abutted surface 88*a* of the first flange 88. In some embodiments, a generally equal circumferential distance D2 (not shown) exists between a non-abutted surface 106*a* of the first arm 106 and a non-abutted surface 90*a* (not shown) of the second flange 90. In certain configurations, the circumferential distance D1 and/or D2 is greater than or equal to the amount of rotation of the lid from the open to the closed position. For example, the circumferential distance D1 and/or D2 can be at least about 60° and/or less than or equal to about 125°. In certain variants, the circumferential distance D1 and/or D2 is greater than or equal to about 80°.

Due to the circumferential distances D1, D2 between the non-abutted surfaces 88*a*, 90*a* of the flanges 88, 90 and the non-abutted surfaces 106*a*, 108*a* of the aims 106, 108, the lid portion 24 can be manually operate without turning the motor 78. If a user were to operate the lid portion 24 manually, the flanges 88, 90 would rotate without applying force to the arms 106, 108 of the clutch member 84, and thus rotate the lid without damaging components of the driving mechanism 58.

Lid Position Sensors

Figure 10A:
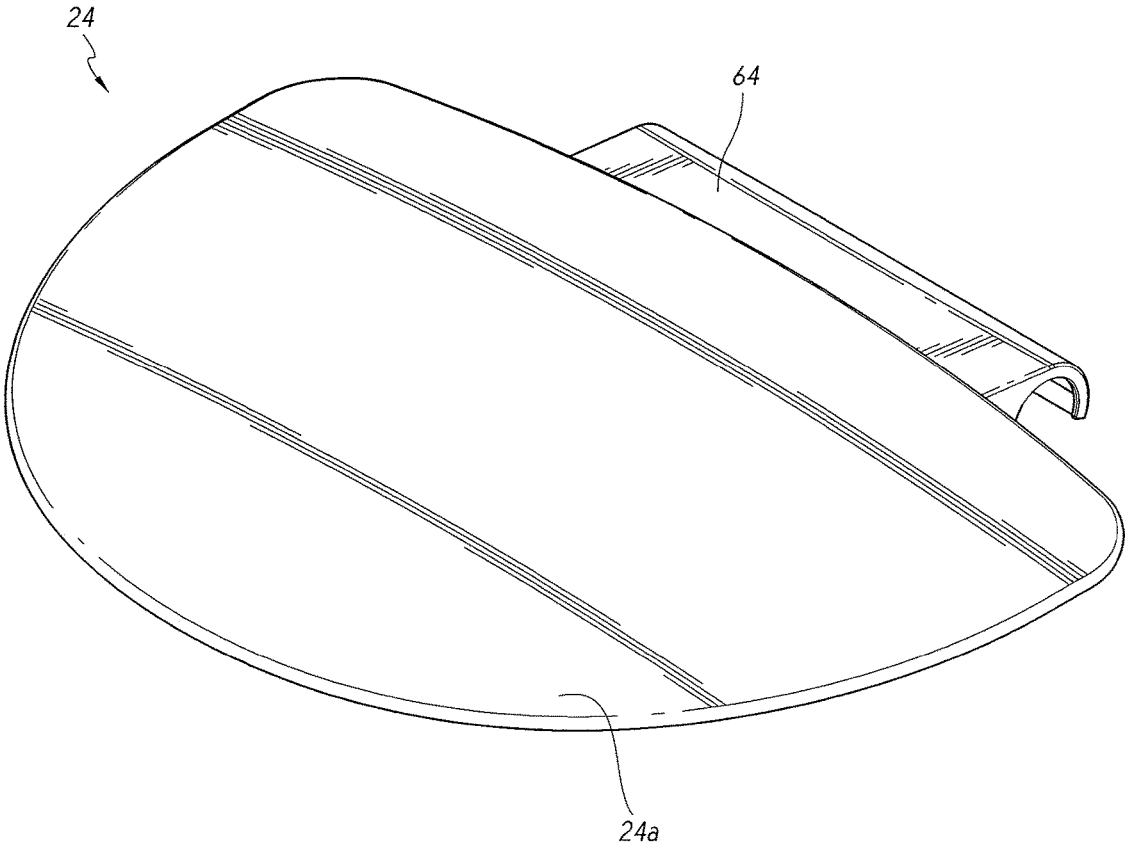
FIG. 10A illustrates a top perspective view of a lid portion of the receptacle assembly shown in FIG. 1.
Figure 10B:
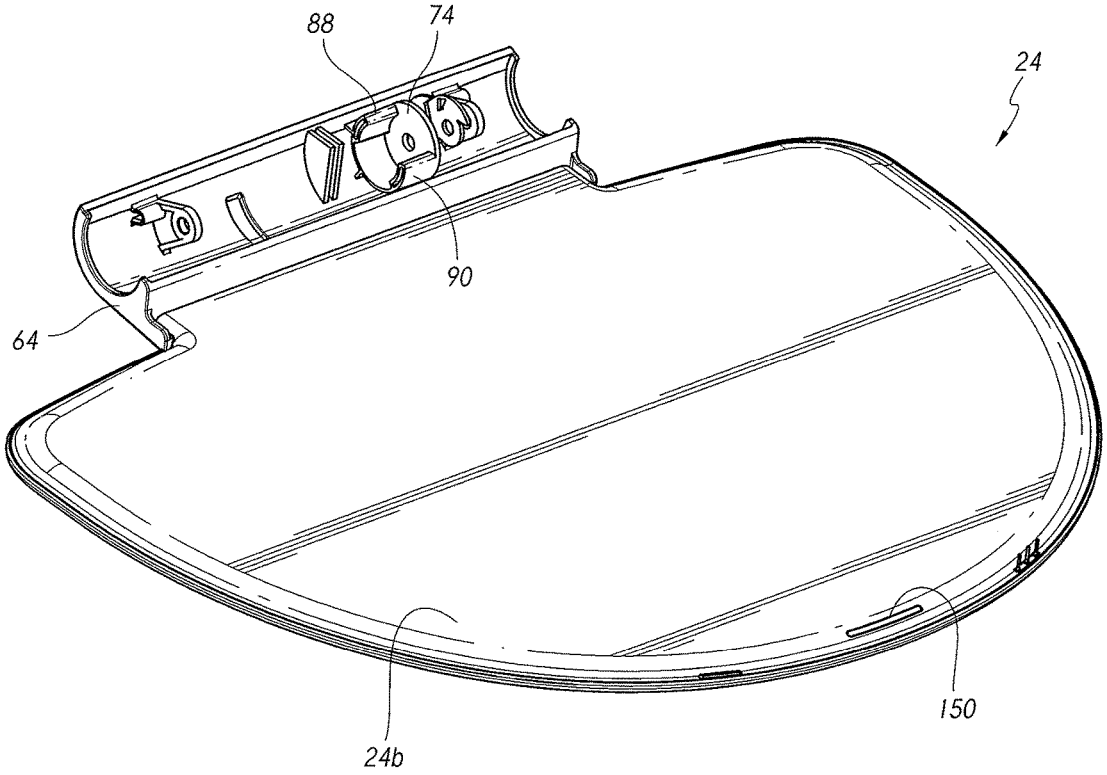
FIG. 10B illustrates a bottom, front perspective view of the lid portion shown in FIG. 10A.
Figure 10C:
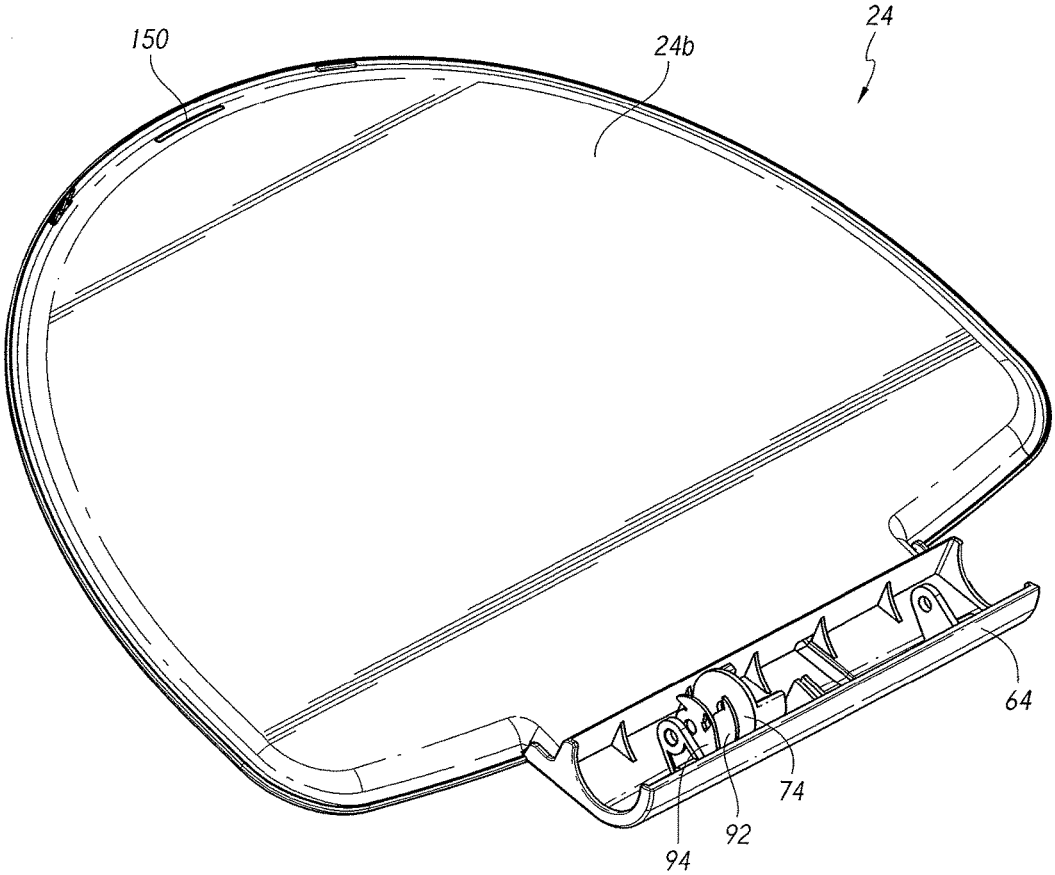
FIG. 10C illustrates a bottom, rear perspective view of the lid portion shown in FIG. 10A.

As shown in FIG. 10C, the lid portion 24 can include one or more lid position sensing elements, such as a first flagging member 92 and a second flagging member 94. The driving mechanism 58 can include one or more position sensors, such as a first position sensor 96 and a second position sensor 98, to detect the position of the lid portion 24, e.g., by detecting the position of the flagging members 92, 94. The motor 78 and the position sensors 96, 98 can communicate with the controller 70 to facilitate control of the movement of the lid portion 24. As shown in FIGS. 11A and 11B, the driving mechanism 58 can include a first position sensor 96 (e.g., a closed position sensor) and a second position sensor 98 (e.g., an open position sensor). In some implementations, the position sensors 96, 98 can include paired optical proximity detectors, such as light emitters, that cooperate with an intermediate sensor 128, such as a light receiver. As illustrated, the position sensors 96, 98 can be located in a single housing, which can facilitate manufacturability and repair and can reduce the overall space occupied by the position sensors 96, 98.

When the lid portion 24 is in its home or fully closed position, the first flagging member 92 is located between the first position sensor 96 and the intermediate sensor 128 and the second flagging member 94 is not located between the second position sensor 98 and the intermediate sensor 128. In this configuration, the first flagging member 92 blocks an emission (e.g., a signal) between the first position sensor 96 and the intermediate sensor 128, which can be interpreted (e.g., by the controller implementing an algorithm) to discern the position of the lid portion 24.

As the lid portion 24 rotates into the fully open position, the first flagging member 92 rotates such that it is no longer between the first position sensor 96 and the intermediate sensor 128, and the second flagging member 94 rotates such that it is between the second position sensor 98 and the intermediate sensor 128. In this configuration, the second flagging member 94 blocks an emissions (e.g., a signal) between the second position sensor 98 and the intermediate sensor 128, which can be interpreted by the controller 70 to discern the position of the lid portion 24.

Any combination of flagging members and position sensors can be used to detect various positions of the lid portion 24. For example, additional positions (e.g., an about halfway opened position) can be detected with additional sensors and flagging members in a manner similar or different from that described above. Some embodiments have flagging members located in the backside enclosure 56 and position sensors on the lid portion 24.

LED Indicator

As shown in FIGS. 10B and 10C, the lid portion 24 can include one or more indicators 150 (e.g., an LED indicator). For example, when the lid portion 24 is open, the indicator 150 can display a certain color of light, e.g., green light. As another example, the indicator 150 can display a certain color of light based on the amount of remaining power, so the user knows when to recharge the power source 66 (e.g., red light can indicate low power). In yet another example, the indicator 150 can provide a light source when the trashcan assembly 20 is being used in the dark.

The indicator 150 can be positioned on a bottom portion of the lid portion 24 such that the indicator 150 is only visible when the lid portion 124 is in an open position. In some embodiments, the exterior of the trashcan assembly is simple and clean, without any buttons switches, and/or indicators. As shown in FIGS. 10B and 10C, the indicator 150 can be positioned at a periphery of the lid portion 24. In some embodiments, the lid portion 24 can include an upper lid 24*a* secured to a lower lid 24*b* (see FIGS. 10A-10C). The one or more indicators 150 can be powered by the power source 66 via cables extending between the upper and lower lids 24*a*, 24*b*.

Terminology

Although the trashcan assemblies have been disclosed in the context of certain embodiments and examples, it will be understood by those skilled in the art that the present disclosure extends beyond the specifically disclosed embodiments to other alternative embodiments and/or uses of the trashcans and obvious modifications and equivalents thereof. In addition, while several variations of the trashcans have been shown and described in detail, other modifications, which are within the scope of the present disclosure, will be readily apparent to those of skill in the art. For example, a gear assembly and/or alternate torque transmission components can be included. For instance, in some embodiments, the trashcan assembly 20 includes a gear assembly. Some embodiment of the gear assembly include a gear reduction (e.g., greater than or equal to about 1:5, 1:10, 1:50, values in between, or any other gear reduction that would provide the desired characteristics), which can modify the rotational speed applied to the shaft 80, clutch member 84, and/or other components.

For expository purposes, the term "lateral" as used herein is defined as a plane generally parallel to the plane or surface of the floor of the area in which the device being described is used or the method being described is performed, regardless of its orientation. The term "floor" floor can be interchanged with the term "ground." The term "vertical" refers to a direction perpendicular to the lateral as just defined. Terms such as "above," "below," "bottom," "top," "side," "higher," "lower," "upper," "upward," "over," and "under," are defined with respect to the horizontal plane.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments.

The terms "approximately," "about," and "substantially" as used herein represent an amount close to the stated amount that still performs a desired function or achieves a desired result. For example, in some embodiments, as the context may dictate, the terms "approximately", "about", and "substantially" may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may dictate, the term "generally perpendicular" can refer to something that departs from exactly parallel by less than or equal to 20 degrees.

Although certain embodiments and examples have been described herein, it will be understood by those skilled in the art that many aspects of the receptacles shown and described in the present disclosure may be differently combined and/or modified to form still further embodiments or acceptable examples. All such modifications and variations are intended to be included herein within the scope of this disclosure. A wide variety of designs and approaches are possible. No feature, structure, or step disclosed herein is essential or indispensable.

Some embodiments have been described in connection with the accompanying drawings. However, it should be understood that the figures are not drawn to scale. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

For purposes of this disclosure, certain aspects, advantages, and novel features are described herein. It is to be understood that not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Moreover, while illustrative embodiments have been described herein, the scope of any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to the examples described in the present specification or during the prosecution of the application, which examples are to be construed as non-exclusive. Further, the actions of the disclosed processes and methods may be modified in any manner, including by reordering actions and/or inserting additional actions and/or deleting actions. It is intended, therefore, that the specification and examples be considered as illustrative only, with a true scope and spirit being indicated by the claims and their full scope of equivalents.

The following is claimed:

1. A trashcan assembly comprising:

a body portion configured to be positioned in an environment;

a lid portion pivotably coupled with the body portion;

a sensor assembly configured to create at least one sensing region during an automated calibration mode, wherein during the automated calibration mode the sensor assembly is configured to substantially continuously and automatically scan the sensing region to detect a change in at least a portion of the environment within the sensing region, the change comprising the detection of a stationary object in the sensing region that was previously not within the sensing region; and an electronic processor comprising a software module, wherein during the automated calibration mode the electronic processor is configured to update a sensing threshold to inhibit unintended opening of the lid portion, and wherein during a non-calibration mode the electronic processor is configured to generate an electronic signal to a power-operated drive mechanism for moving the lid portion from a closed position to an open position when the sensor assembly detects a non-stationary object located within the portion of the environment, wherein the software module provides one or more adaptable sensing conditions that can be modified based on the change in the portion of the environment.

2. The trashcan assembly of claim 1, wherein the stationary object comprises the underside of a table or desk and the non-stationary portion comprises a hand.

3. The trashcan assembly of claim 1, wherein the adaptable sensing condition is a normalized sensing threshold being normalized to the change in the portion of the environment.

4. The trashcan assembly of claim 3, wherein the electronic processor is configured to generate the electronic signal to the power-operated drive mechanism only when the detected object exceeds the normalized sensing threshold.

5. The trashcan assembly of claim 1, wherein the sensor assembly is configured to detect a present state and one or more past states of the portion of the environment.

6. The trashcan assembly of claim 5, wherein the electronic processor is configured to compute a stability threshold, based on the one or more past states of the environment, the stability threshold being determined based on proximity measurements in at least one of the sensing regions.

7. The trashcan assembly of claim 6, wherein the electronic processor is configured to determine whether the portion of the environment is stable, based at least in part on a comparison of the present state of the portion of the environment and the stability threshold.

8. A trashcan assembly of claim 7, wherein the electronic processor is configured to modify the adaptable sensing condition when the environment is stable, based on a comparison of the change in the portion of the environment and a calibrated value.

9. The trashcan assembly of claim 8, wherein the calibrated value is a predetermined value, such that the object detected within the sensing region causes the electronic processor to generate the electronic signal when the detection exceeds the calibrated value.

10. The trashcan assembly of claim 8, wherein the adaptable sensing condition is normalized to the changes in the portion of the environment when the change in the portion of the environment exceeds the calibrated value.

11. The trashcan assembly of claim 8, wherein the adaptable sensing condition is modified to the calibrated value when the calibrated value exceeds the change in the portion of the environment.

12. The trashcan assembly of claim 1, wherein:

the adaptable sensing condition comprises a sensing threshold of a receiver of the sensing assembly, the trashcan assembly being configured to open the lid portion in response to the receiver detecting a signal about the sensing threshold; and in response to the detection of the stationary object in the sensing region that was previously not within the sensing region, the sensing threshold is reduced.

13. The trashcan assembly comprising:

a body portion being surrounded by an environment;

a lid portion pivotably coupled with the body portion;

a sensor assembly configured to create one or more sensing regions, wherein the sensor assembly is configured to detect changes in at least a portion of the environment within the one or more sensing regions, a computer-readable memory storing executable instructions; and one or more physical processors in communication with the computer-readable memory, wherein the one or more physical processors are programmed by the executable instructions to at least:

instruct the sensor assembly to perform a substantially continuous scan of the sensing regions to enable the trashcan assembly to substantially continuously and automatically monitor a present state of the portion of the environment located in each sensing region;

determine whether the portion of the environment of each sensing region is stable, the stability determination being based on a stability threshold for each sensing region, the stability threshold being determined based on proximity measurements in at least one of the sensing regions;

adjust a sensing threshold corresponding to at least one of the plurality of sensing regions, the adjustment being based on a calibrated value and an environmental measurement for the corresponding sensing region; and send an electric signal to operate the lid portion of the trashcan assembly from a closed position to an open position when an object is detected within at least one sensing region, based in part on the detection of the object exceeding the adjusted sensing threshold.

14. The trashcan assembly of claim 13, wherein the determining the portion of the environment of each sensing region is stable further comprises instructions to:

retrieve a set of past measurements related to past states of the portion of the environment;

determine the stability threshold for each of the sensing region, based on the set of past measurement for each sensing region; and compare the stability threshold and the measured present state of the portion of the environment for each sensing region, wherein the portion of the environment for each sensing region is stable when the present state of the portion of the environment is within the stability threshold.

15. The trashcan assembly of claim 13, wherein the stability threshold includes an average of the set of past measurements and a variation in the average of the set of past measurements.

16. The trashcan assembly of claim 13, wherein the instructions to adjust the sensing threshold of at least one of the plurality of sensing regions, further comprises instructions to compare the environmental measurement and a calibrated value.

17. The trashcan assembly of claim 16, wherein the environmental measurement is based on the average of the set of past measurements.

18. The trashcan assembly of claim 16, wherein the environmental measurement is based on the measured present state of the environment.

19. The trashcan assembly of claim 16, wherein the calibrated value is a predetermined value, such that the object detected within the sensing region causes the processor to send the electric signal.

20. A trashcan assembly of claim 16, wherein the instructions to adjust the sensing threshold of at least one of the plurality of sensing regions, further comprises instructions to set the sensing threshold to the calibrated value when the environmental measurement is less than the calibrated threshold.

21. The trashcan assembly of claim 16, wherein the instructions to adjust the sensing threshold of at least one of the plurality of sensing regions, further comprises instructions to set the sensing threshold to the environmental measurement when the environmental measurement is greater than the calibrated value.

22. The trashcan assembly of claim 16, wherein the instructions to adjust the sensing threshold of at least one of the plurality of sensing regions, further comprises instructions to set the sensing threshold to the environmental measurement plus a margin when the environmental measurement is greater than the calibrated value.

* * * * *